US008133065B2

(12) United States Patent
Horiuchi et al.

(10) Patent No.: US 8,133,065 B2
(45) Date of Patent: Mar. 13, 2012

(54) LEVER-TYPE CONNECTOR

(75) Inventors: Hidefumi Horiuchi, Yokkaichi (JP); Kimiyasu Okumura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/968,349

(22) Filed: Dec. 15, 2010

(65) Prior Publication Data

US 2011/0151694 A1 Jun. 23, 2011

(30) Foreign Application Priority Data

Dec. 17, 2009 (JP) ..... 2009-286288
Dec. 23, 2009 (JP) ..... 2009-291564

(51) Int. Cl.
*H01R 13/62* (2006.01)

(52) U.S. Cl. ..... 439/157

(58) Field of Classification Search ..... 439/152–160, 439/310, 372, 347
See application file for complete search history.

(56) References Cited

U.S. PATENT DOCUMENTS

| | | | | |
|---|---|---|---|---|
| 5,954,528 | A | 9/1999 | Ono et al. | |
| 6,164,991 | A * | 12/2000 | Matsuura et al. | 439/157 |
| 6,332,789 | B1 * | 12/2001 | Okabe | 439/157 |
| 6,343,944 | B1 * | 2/2002 | Okabe | 439/157 |
| 6,547,574 | B2 * | 4/2003 | Sasaki et al. | 439/157 |
| 7,744,390 | B2 * | 6/2010 | Tyler et al. | 439/157 |

* cited by examiner

*Primary Examiner* — Jean F Duverne
(74) *Attorney, Agent, or Firm* — Gerald E. Hespos; Michael J. Porco

(57) ABSTRACT

A lever-type connector has a device-side housing (11) and a wire-side housing (41) to be connected with the device-side housing (11). Cam pins (15) project from the wire-side housing (11). Levers (60) are supported rotatably on the wire-side housing (41) and include cam grooves (62) engageable with the cam pins (15). A holder (70) is held on the wire-side housing (41) slidably in a connecting direction and an opposite direction thereof and includes coupling grooves (74) engageable with coupling pins (63) on the lever (60). The holder (70) can be moved in the connecting direction to move the lever ((60) and pull the housings (11, 41) together. The holder (70) has resilient pieces (75) with engaging surfaces (75B) and the levers (60) have engaging claws (66) for engaging the engaging surfaces (75B) to prevent rotation of the levers (60).

14 Claims, 25 Drawing Sheets

LEVER-TYPE CONNECTOR

BACKGROUND OF THE INVENTION

1. Field of the Invention

The invention relates to a lever-type connector provided with a fixing member for fixing a lever.

2. Description of the Related Art

Connection resistance is large for multipolar connectors and attempts have been made to improve connectability. For example, U.S. Pat. No. 5,954,528 discloses a lever-type connector, with first and second housings that are connectable with one another. The first housing is formed with cam pins. Levers are mounted rotatably on the second housing and are formed with cam grooves that engage the cam pins. An operating member is held on the second housing and can slide in connecting and separating directions. The operating member is slid in the connecting direction to guide coupling pins on the levers and to rotate the levers for pulling the connectors together. However, this lever-type connector has no structure for holding the connectors in a connected state. Vibration or pulling forces on the wires can shake the operating member or the levers and can cause the connectors to separate. Thus, studies have considered a connector with a holding member for maintaining a connected state. However, a separate holding member would enlarge a multipolar lever-type connector with a lever and an operating member.

The invention was developed in view of the above situation and an object thereof is to provide a lever-type connector that maintains a connection completed state without enlarging a lever-type connector main body itself.

SUMMARY OF THE INVENTION

The invention relates to a lever-type connector with first and second housings that are connectable with each other. At least one cam pin projects from the first housing and at least one lever is supported displaceably on the second housing. The lever has at least one cam groove engageable with the cam pin. An operating member is held on the second housing and is displaceable substantially in a connecting direction and an opposite direction thereof. At least one coupling pin is formed on the lever or the operating member and at least one coupling groove is formed on the other of the lever or the operating member. The coupling pin and the coupling groove are engageable with each other. The coupling pin is guided to an end of the coupling groove by operating the operating member substantially in the connecting direction. Thus, the lever is displaced to pull the housings toward each other and to connect the housings with each other. The two housings are held in a connection completed state by a connection locking mechanism.

The connection locking mechanism preferably comprises a resilient piece on a surface of the operating member substantially facing the lever and an engaging claw that projects from the lever. The engaging claw is engageable with an engaging surface of the resilient piece to fix the lever when the two housings reach a connection completed state. The engaging surface preferably is aligned at an angle to intersect a sliding direction.

The lever preferably is supported rotatably on the second housing. The lever is rotated by operating the operating member in the connecting direction to pull the two housings toward each other and to connect the two housings with each other.

The resilient piece of the operable member and the engaging claw of the lever preferably engage in a clearance between the operable member and the lever to fix the lever when the housings reach the connection completed state. Thus, the housings can be held in a connected state without enlarging a conventional lever-type connector.

An intermediate part of the resilient piece preferably is supported on the operating member. The engaging claw is formed at one end of the resilient piece and an unlocking portion is formed on the opposite end. The unlocking portion can be pressed to deform the resilient piece and disengage the engaging claw and the engaging surface. The housings then can be separated for maintenance or other reason.

The unlocking portion preferably is provided at an end of the operating member opposite to a connection side. Accordingly, the housings can be separated easily by pressing the unlocking portion located at a rear end portion of the connector.

The connection locking mechanism preferably has: at least one resilient lock piece provided at a back end portion of the coupling groove reached by the coupling pin when the two housings reach a connection completed state. The resilient locking piece is adapted to hold the coupling pin in position. Utilizing the existing coupling pin as a part of the member for maintaining the connected state enables the two housings to be held in the connected state without enlarging the connector.

The resilient lock piece preferably is resiliently deformable substantially in a depth direction of the coupling groove at a peripheral edge portion of the coupling groove.

A leading end portion of the resilient lock piece preferably projects from an upper end surface of the coupling groove. A flange preferably is formed at an outer peripheral edge of the leading end of the coupling pin projecting from the coupling groove and extends along an upper end surface of the coupling groove. The flange presses the resilient lock piece toward a bottom side of the coupling groove as the coupling pin approaches the back end of the coupling groove and resiliently restores to lock the flange after the back end is reached. The provision of the member for fixing the flange of the coupling pin at a peripheral part of the coupling groove enables the housings to be held in the connected state without enlarging the connector.

The coupling pin preferably is on the lever and the coupling groove preferably is in the operating member. The resilient lock piece preferably includes a supporting point standing up from a part of the operating member near the back end of the coupling groove and an engaging claw that is displaced substantially along a longitudinal direction of the coupling pin to engage the leading end of the coupling pin. Accordingly, the housings can be held in the connected state without enlarging the connector.

A pressable portion preferably projects from the resilient locking piece and can be pressed in a direction for disengaging the resilient lock piece from the coupling pin. Thus, the resilient lock piece and the coupling pin can be disengaged by pressing the pressable portion so that the housings can be separated easily for maintenance or the like.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector in accordance with a first embodiment of the invention is illustrated in FIGS. 1 to 7 and comprises a device-side connector 10 to be fixed on a mounting portion Y of a device and a wire-side connector 40. The device-side connector 10 includes a device-side housing 11 made e.g. of synthetic resin and terminal fittings (not shown) are mounted in the device-side housing 11.

Figure 1:
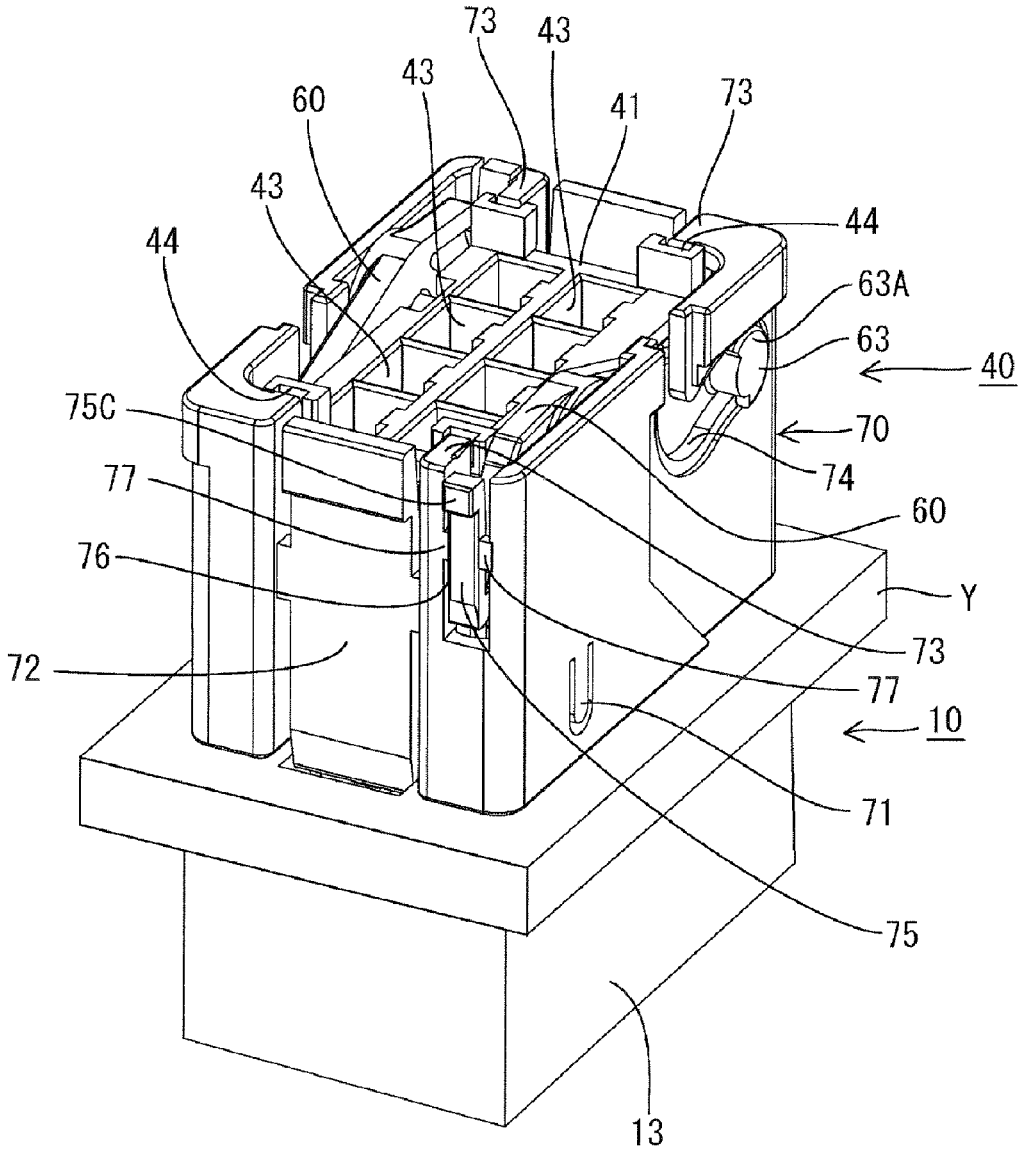
FIG. 1 is a perspective view showing a connection completed state of a device-side and a wire-side connectors according to a first embodiment.
Figure 3:
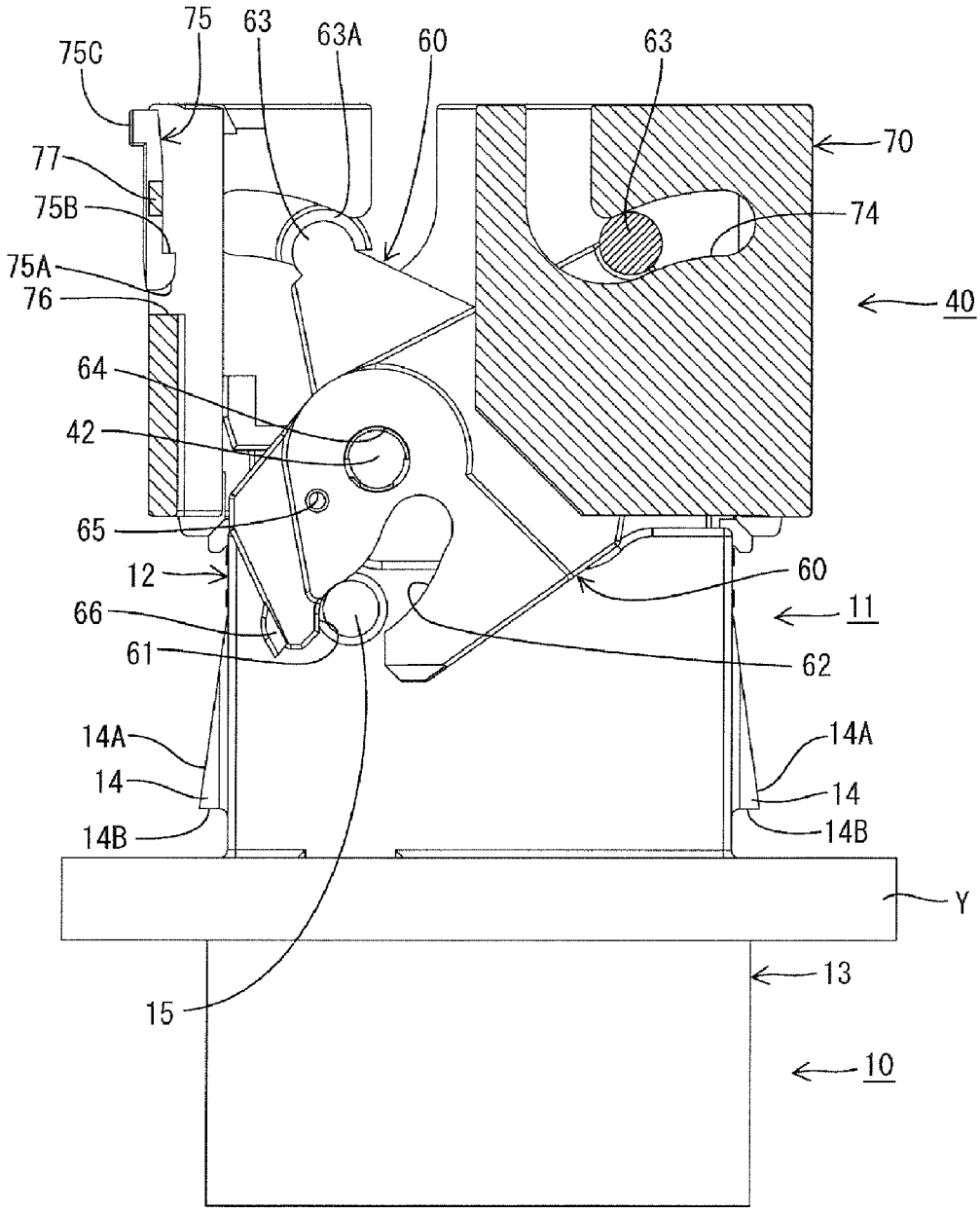
FIG. 3 is a side view in section showing a partly connected state of the device-side and wire-side connectors.
Figure 4:
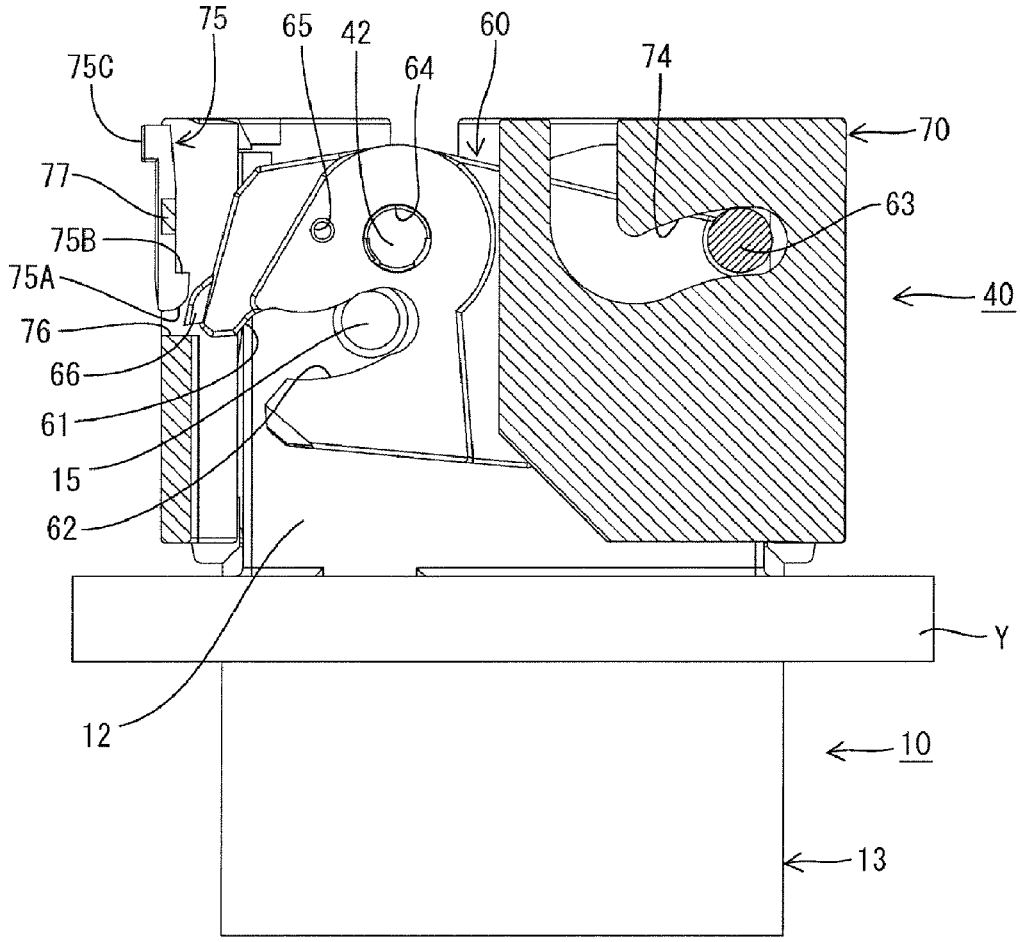
FIG. 4 is a side view in section showing a state before an engaging surface and an engaging claw are engaged in the partly connected state of the device-side and wire-side connectors.

A substantially rectangular receptacle 12 is formed in a front part of the device-side housing 11 and a main body 13 is formed in a rear part, as shown in FIGS. 1 and 3. Cavities form a matrix inside the main body 13.

Inclined engaging portions 14 are formed at intermediate positions of opposite outer shorter side surfaces of the receptacle 12 and cam pins 15 are formed on opposite outer longer side surfaces. Each inclined engaging portion 14 has a widened slope 14A and a step 14B. The slope 14A extends substantially straight from a position behind the front opening edge of the receptacle 12 to a position before the rear end of the receptacle 12. The step 14B extends at an angle to a connecting direction at the rear end of the widened slope 14A. The cam pins 15 project at positions behind the front edges of the longer side surfaces of the receptacle 12 and are displaced toward centers of the longer side surfaces from lateral end edges thereof. The cam pins 15 on the receptacle 12 are arranged point-symmetrically with respect to a center of a connection surface.

The wire-side connector 40 includes a wire-side housing 41 made e.g. of synthetic resin and configured to be accommodated into the receptacle 12 of the device-side housing 11, as shown in FIG. 1. Terminal fittings (not shown) connected to wires are to be mounted in the wire-side housing 41. Supporting shafts 42 project from side surfaces of the wire-side housing 41 and support levers 60. A holder 70 surrounds the levers 60 and holds the levers 60 on the wire-side housing 41.

The wire-side housing 41 is substantially rectangular and includes two rows of cavities 43, with each row having four cavities 43 arranged in a longer-side direction, as shown in FIG. 1. The supporting shafts 42 for rotatably supporting the levers 60 project from rear portions of the longer outer side surfaces and are arranged substantially point-symmetrically with respect to a center of a connection surface. Guide grooves 44 are formed at both end portions of both shorter outer side surfaces and extend substantially straight in forward and backward directions.

Figure 2:
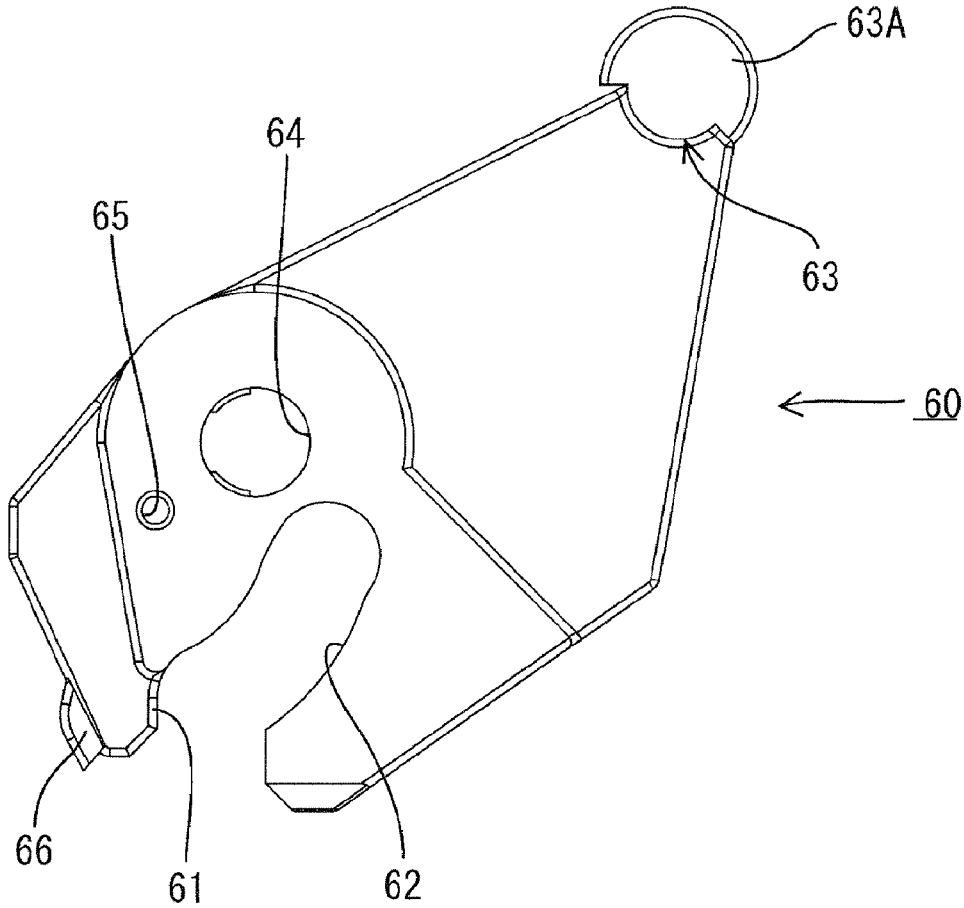
FIG. 2 is a plan view of a lever.

Each lever 60 substantially is a plate made e.g. of synthetic resin and has one wide end and a tapered end as shown in FIG. 2. An opening 61 is formed in the wide end of the lever 60, and an arcuate cam groove 62 extends integrally from the opening 61 substantially in a connecting direction. On the other hand, a coupling pin 63 projects from the taper end of the lever and a flange 63A is formed at the leading end of the coupling pin 63. Bearing holes 64 are formed near the back ends of the cam grooves 62 and engage with the respective supporting shafts 42 of the wire-side housing 41. The levers 60 are mounted substantially point symmetrically on the wire-side housing 41 with respect to the center of the connection surface due to a relationship between the supporting shafts 42 of the wire-side housing 41 and the levers 60.

Figure 5:
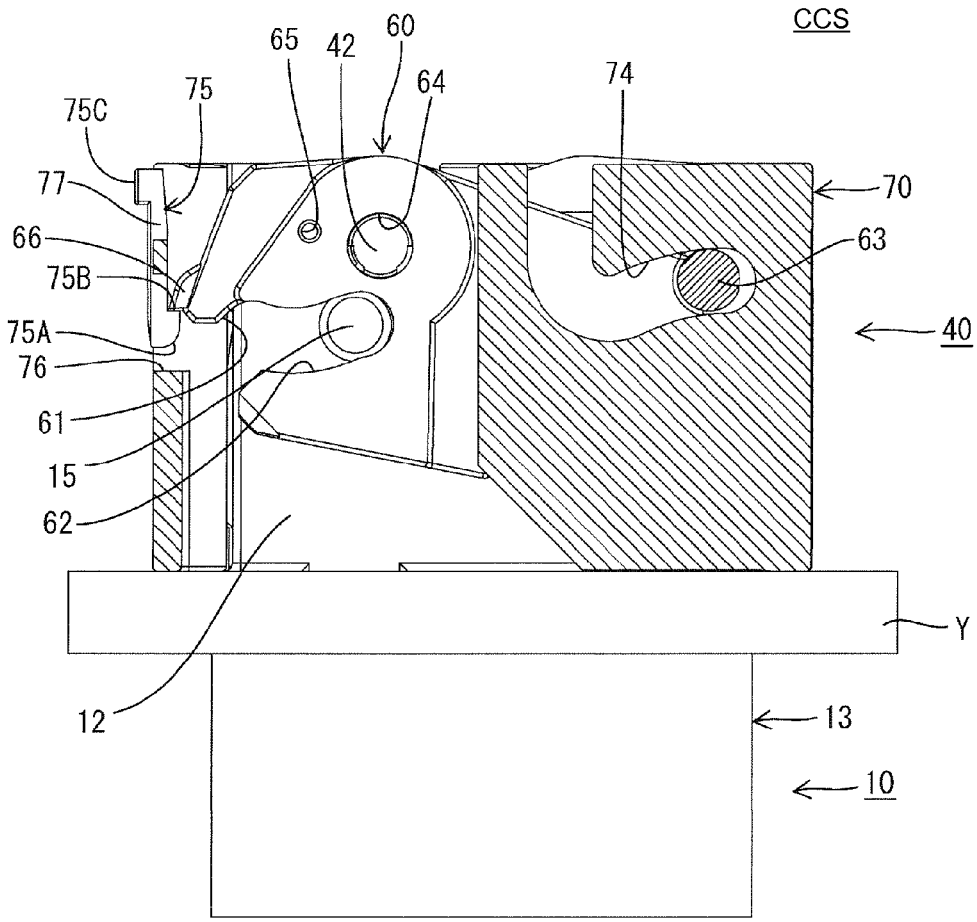
FIG. 5 is a side view in section showing the connection completed state of the device-side and wire-side connectors.

Each lever 60 mounted on the supporting shaft 42 of the wire-side housing 41 is rotatable between a connection initial state where the cam pin 15 is in the opening 61 and can enter the cam groove 62, as shown in FIG. 3, and a connection completed state CCS where the cam pin 15 substantially reaches an end position of the cam groove 62 to complete connection of the connectors, as shown in FIG. 5.

At the connection initial state, the openings 61 are aligned to receive the cam pins 15 of the device-side housing 11 at the time of connecting the two connectors 10, 40 so that the cam pins 15 can enter the cam grooves 62. Cam forces are generated by rotating the levers 60 so that the cam pins 15 are guided to the back ends of the cam grooves 62 for pulling the wire-side housing 41 into the device-side housing 11.

The holder 70 is made e.g. of synthetic resin, as shown in FIGS. 1 and 3 and defines a substantially rectangular tube that can accommodate the levers 60 and the wire-side housing 41 inside. Resiliently deformable resilient holding pieces 72 are provided on the shorter outer side surfaces of the holder 70 at positions substantially corresponding to the inclined engaging portions 14 of the device-side housing 11. Unillustrated holding claws are formed at inner sides of the leading ends of the resilient holding pieces 72. The resilient holding pieces 72 move onto the inclined engaging portions 14 and deform out immediately before the device-side connector 10 and the wire-side connector 40 reach the connection completed state CCS. The resilient holding pieces 72 restore resiliently when the connectors 10, 40 reach the connection completed state CCS and the holding claws (not shown) engage the steps 14B of the inclined engaging portions 14 to maintain the connection completed state CCS.

Insertable portions 73 project in on the holder 70 at the opposite sides of the resilient holding pieces 72 at positions corresponding to the guide grooves 44 of the wire-side housing 41. The insertable portions 73 slide in the guide grooves 44 immediately before the two connectors 10, 40 reach the connection completed state CCS so that the wire-side housing 41 is guided and accommodated into the holder 70. Further, the levers 60 are accommodated into spaces defined by the longer wall surfaces of the holder 70 and the insertable portions 73.

Coupling grooves 74 are formed in the opposite longer wall surfaces of the holder 70 at positions corresponding to the coupling pins 63 of the levers 60. Each coupling groove 74 extends substantially straight in the connecting direction from a position displaced from the longitudinal center toward one lateral edge at the rear opening edge and is obliquely bent at an acute angle toward the other lateral edge.

The coupling pins 63 of the levers 60 are mounted slidably in the coupling grooves 74, and the connection initial state is reached when the coupling pins 63 slightly pass the bent positions of the coupling grooves 74. The connection initial state is set by engaging resilient holding pieces 71 provided in the wall surfaces of the holder 70 with recesses 65 formed adjacent to the bearing holes 64 of the levers 60 to engage the levers 60 with the holder 70. The flanges 63A of the coupling pins 63 engaged peripheral edges of the coupling grooves 74 to retain the coupling pins 63 in the coupling grooves 74.

Figure 6:
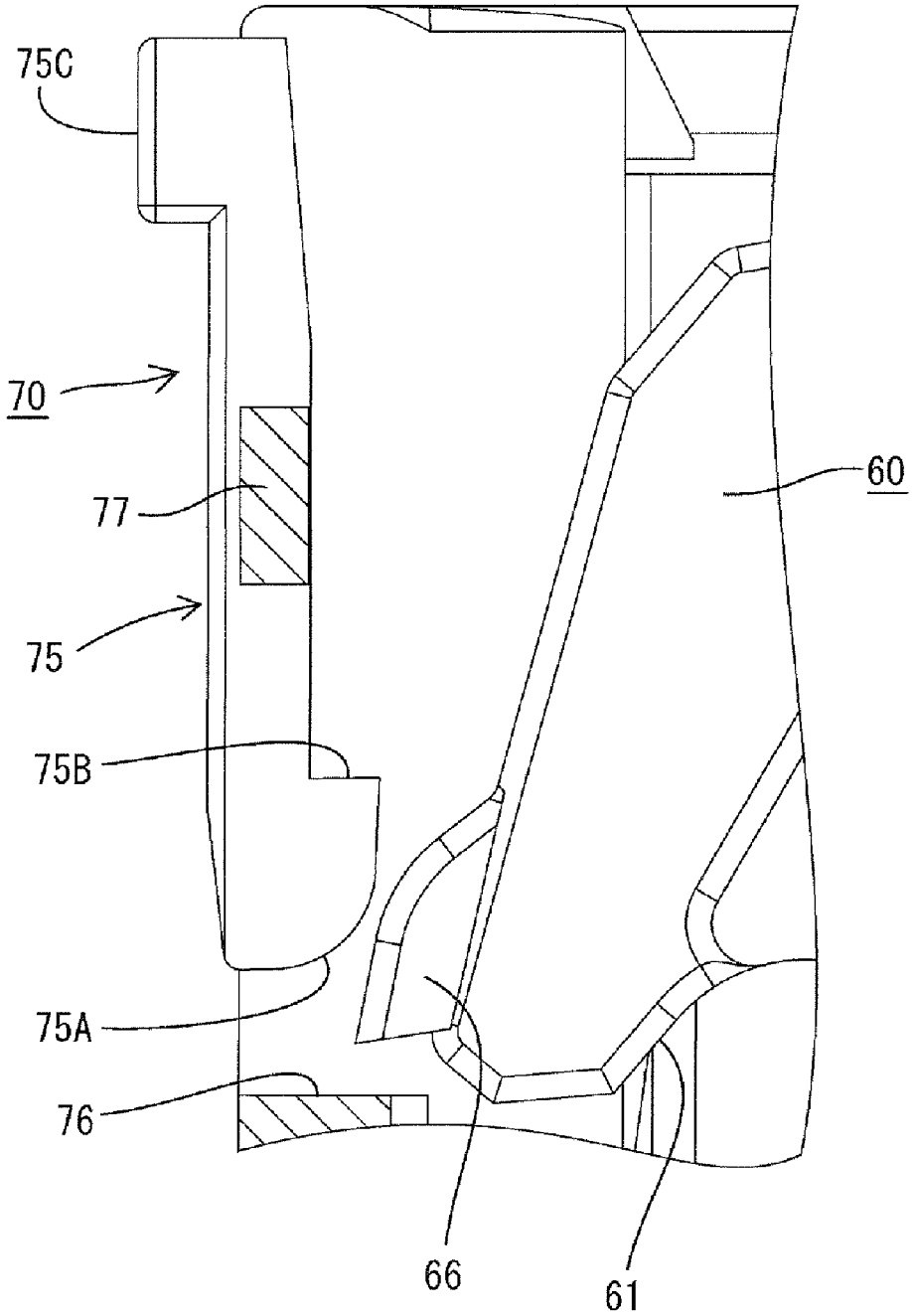
FIG. 6 is a partial enlarged view showing a state before the engaging surface and the engaging claw are engaged.

A narrow arcuate engaging claw 66 extends from an intermediate part of an end surface of the wide end of the lever 60 toward the opening 61 of the lever 60 (see FIG. 6).

Resilient pieces 75 are formed in the shorter walls of the holder 70 adjacent to the resilient engaging pieces 72 and at positions corresponding to the engaging claws 66 of the lever 60. Each resilient piece 75 is formed by slits 76 at three sides, but not at a rear end so that the resilient pieces 75 extend substantially in the connecting direction from the rear end. A support 77 is formed at an intermediate position of the slit 76 at one longer side of the resilient piece 75 to join the resilient piece unitarily to the wall of the holder 70 and to support the resilient piece 75.

A substantially round surface 75A is formed at the leading end of the resilient piece 75 and bulges toward the lever 60 while curving toward the back at an angle to the connecting direction. An engaging surface 75B is located behind the round surface 75A and is engageable with the engaging claw 66 of the lever 60. A substantially square unlocking portion 75C projects out from an outer surface of a rear end portion of the each resilient piece 75. The unlocking portion 75C can be pressed resiliently deform the resilient piece 75 and to disengage the engaging claw 66 of the lever 60 from the engaging surface 75B.

Figure 7:
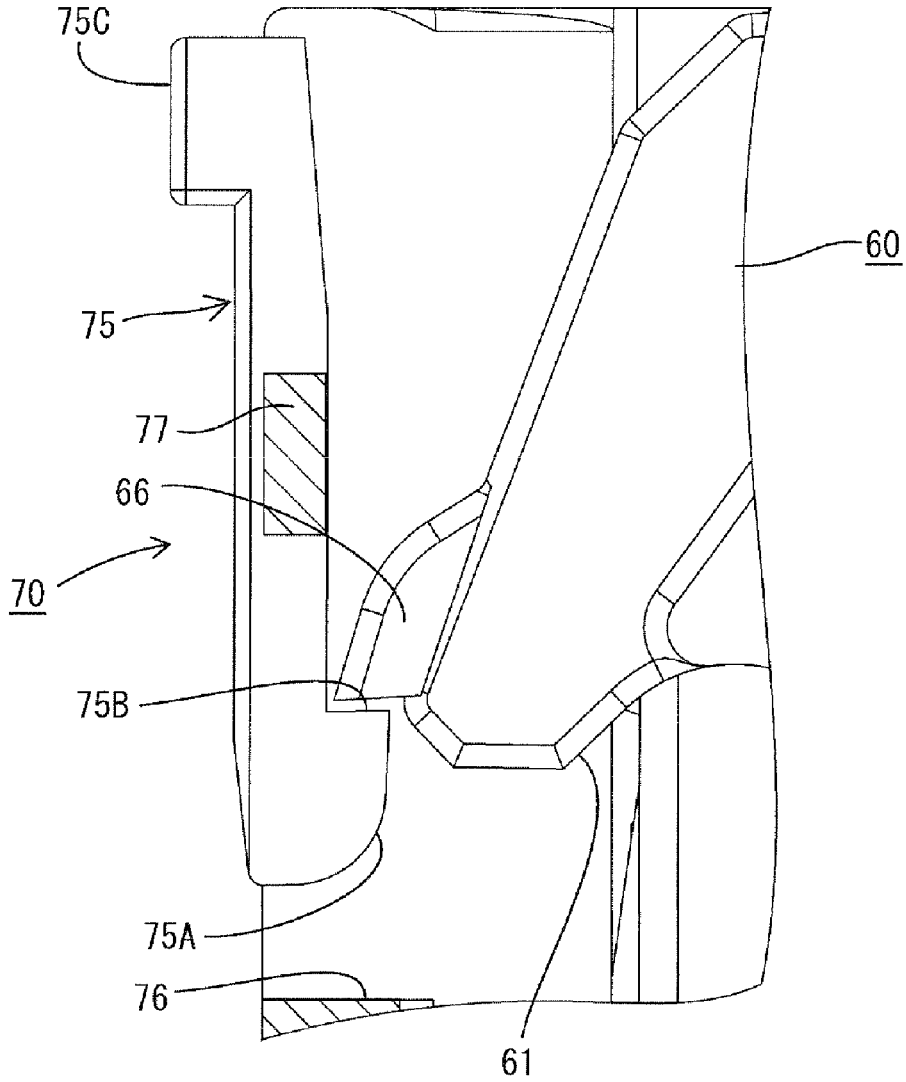
FIG. 7 is an enlarged view showing the state where the engaging surface and the engaging claw are engaged.

Arcuate parts on the engaging claws 66 of the levers 60 contact the round surfaces 75A of the resilient pieces 75 immediately before the connectors 10, 40 reach the connection completed state CCS. Thus, the round surfaces 75A move onto the arcuate parts of the engaging claws 66 and the front ends of the resilient pieces 75 deform out on the holder 70. The round parts of the engaging claws 66 pass the round surfaces 75A of the resilient pieces 75 when the connectors 10, 40 reach the connection completed state CCS. Thus, the end surfaces of the engaging claws 66 engage the engaging surfaces 75B of the resilient pieces 75, as shown in FIG. 7, to prevent displacement of the levers 60 and to hold the connectors 10, 40 in the connection completed state CCS.

The connector is assembled by accommodating the wire-side housing 41 into the receptacle 12 of the device-side connector 10, as shown in FIG. 3, so that the openings 61 of the levers 60 and the corresponding cam pins 15 of the device-side housing 11 engage at the connection initial state. The holder 70 then is pushed in the connecting direction so that the coupling pins 63 of the levers 60 slide toward the ends of the coupling grooves 74 to rotate the levers 60 in connecting directions. Thus, a cam action of the cam pins 15 of the device-side housing 11 and the cam grooves 62 of the levers 60 pull the connectors 10, 40 toward each other.

The arcuate parts of the engaging claws 66 of the levers 60 contact the round surfaces 75A of the resilient pieces 75 immediately before the connectors 10, 40 reach the connection completed state CCS. Thus, the resilient pieces 75 move onto the engaging claws 66 to deform the front ends of the resilient pieces 75 outwardly of the holder 70. The holder 70 then is pushed farther in the connecting direction so that the round parts of the engaging claws 66 pass the round surfaces 75A of the resilient pieces 75. Thus, the end surfaces of the engaging claws 66 and the engaging surfaces 75B of the resilient pieces 75 engage to prevent rotation of the levers 60. In this way, the connectors 10, 40 are held in the connection completed state CCS to ensure an electrically conductive state.

Providing the engaging claws 66 on the ends of the levers 60 and forming the resilient pieces 75 in the walls of the holder 70 enable a member for holding the connectors to be smaller than a holding member separate and outside the holder 70.

A connector according to a second embodiment of the invention is illustrated in FIGS. 8 to 13 and includes a device-side connector 110 to be mounted on a mounting portion Y of a device and a wire-side connector 130 that receives terminal fittings (not shown) connected to wires. In the following description, "front" and "rear" mean front and rear ends in operating directions for connecting the two connectors.

The device-side connector 110 includes a device-side housing 111 made e.g. of synthetic resin and terminal fittings (not shown) are mounted in the device-side housing 111.

Figure 8:
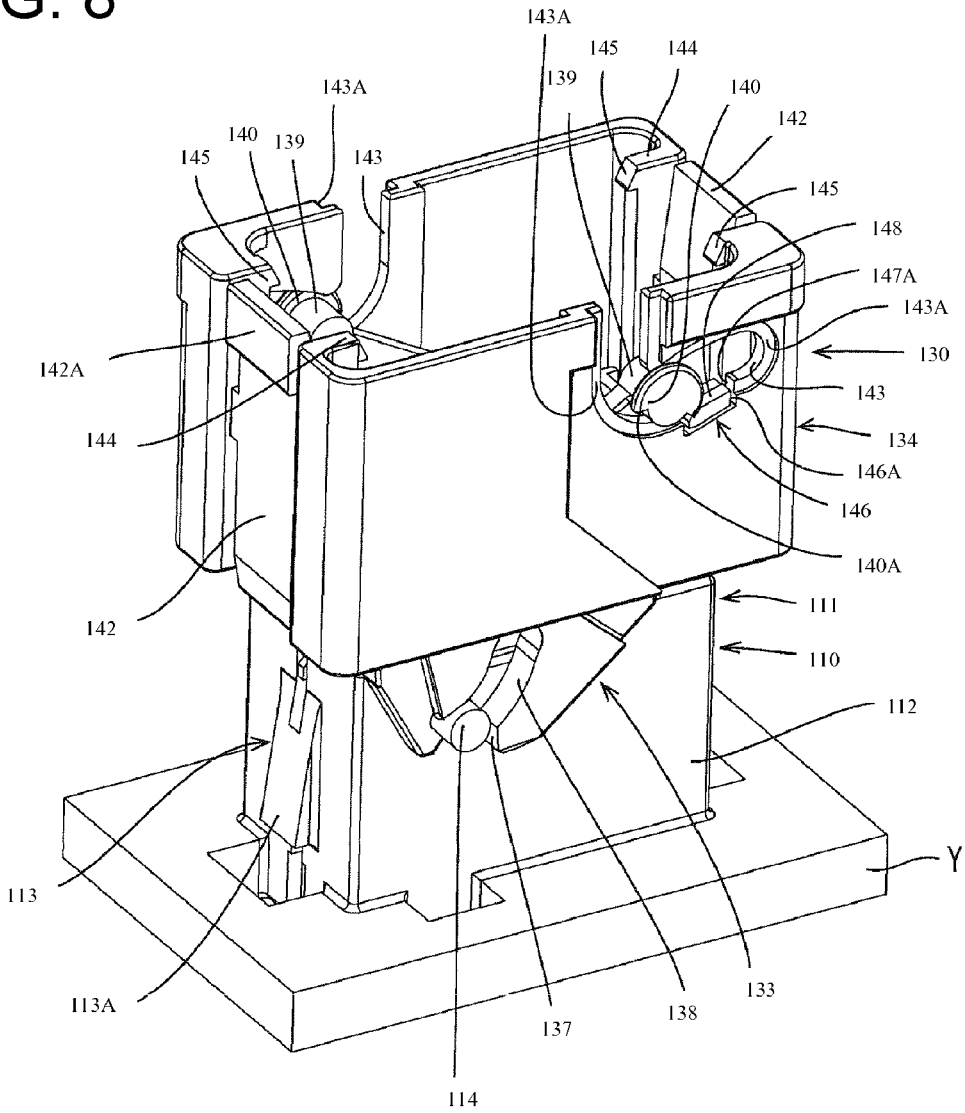
FIG. 8 is a perspective view showing a state before a device-side and a wire-side connectors according to a second embodiment of the present invention are connected.
Figure 10:
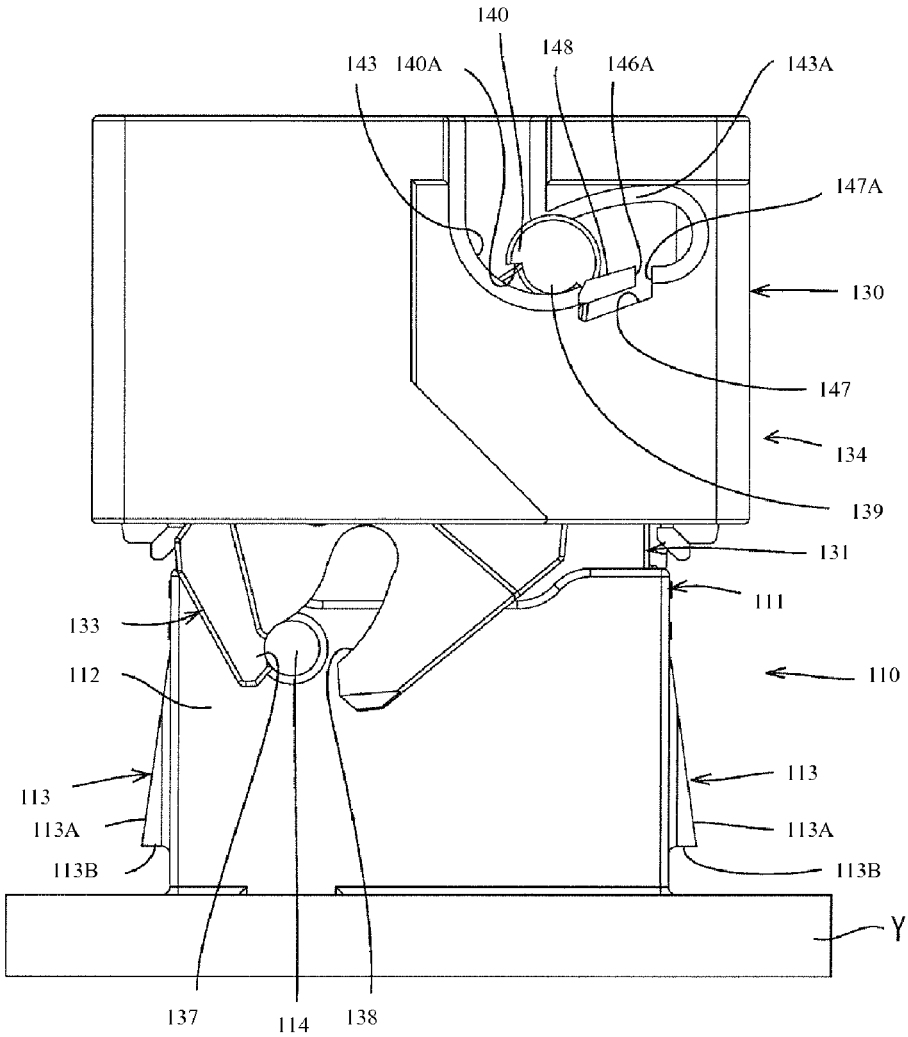
FIG. 10 is a side view showing the state before the device-side and wire-side connectors according to the second embodiment are connected.

A rectangular receptacle 112 is formed in a front part the device-side housing 111, as shown in FIG. 8 or 10, and a main body (not shown) is formed in a rear part. Cavities are formed at stages to define a matrix inside the main body. Inclined engaging portions 113 are formed at intermediate central positions of opposite outer short side surfaces of the receptacle 112. Each inclined engaging portion 113 has a widened slope 113A extending substantially straight from a position behind the front opening edge of the receptacle 112 to a position before the rear end of the receptacle 112 and a step 113B extends at an angle to a connecting direction at the rear end of the widened slope 113A. Cam pins 114 are formed on the opposite longer outer side surfaces of the receptacle 112. The cam pins 114 project at positions behind the front edges of the longer side surfaces of the receptacle 112 and are displaced toward centers of the longer side surfaces from lateral end edges. The cam pins 114 on the receptacle 112 are arranged point-symmetrically with respect to a center of a connection surface.

The wire-side connector 130 has a wire-side housing 131 made e.g. of synthetic resin and terminal fittings (not shown) connected to wires are mounted therein. The wire-side housing 131 can be accommodated into the receptacle 112 of the device-side housing 111. Levers 133 are supported on side surfaces of the wire-side housing 131, as shown in FIGS. 9 and 10, and a holder 134 surrounds and holds the levers 133.

Figure 9:
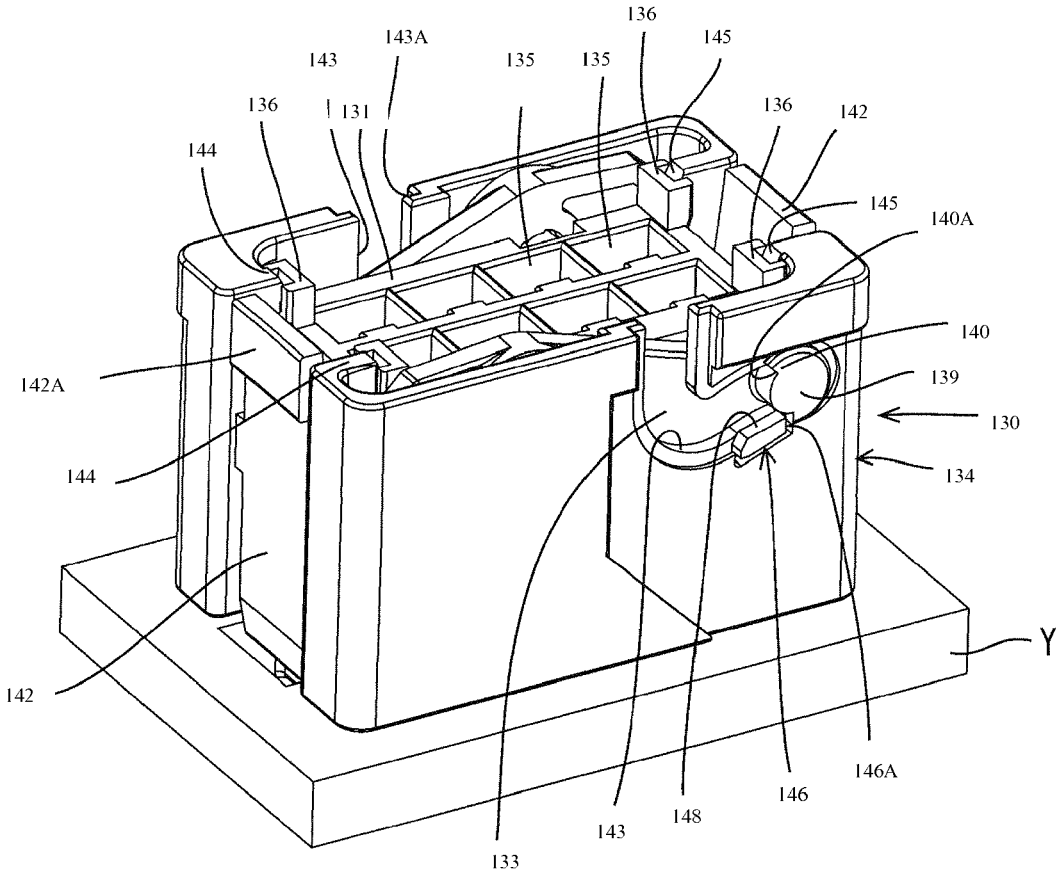
FIG. 9 is a perspective view showing a connection completed state of the device-side and wire-side connectors according to the second embodiment.

The wire-side housing 131 is substantially rectangular and has eight cavities 135 arranged in two rows that are spaced apart in a shorter side direction so that each row has four cavities 135 arranged in a longer side direction, as shown in FIG. 9. Supporting shafts (not shown) project substantially point-symmetrically with respect to a center of a connection surface in rear end portions of longer outer side surfaces and rotatably support the levers 133. Guide grooves 136 extend in forward and backward directions at four corners of a rear end surface and are integral to the shorter side surfaces.

Figure 11:
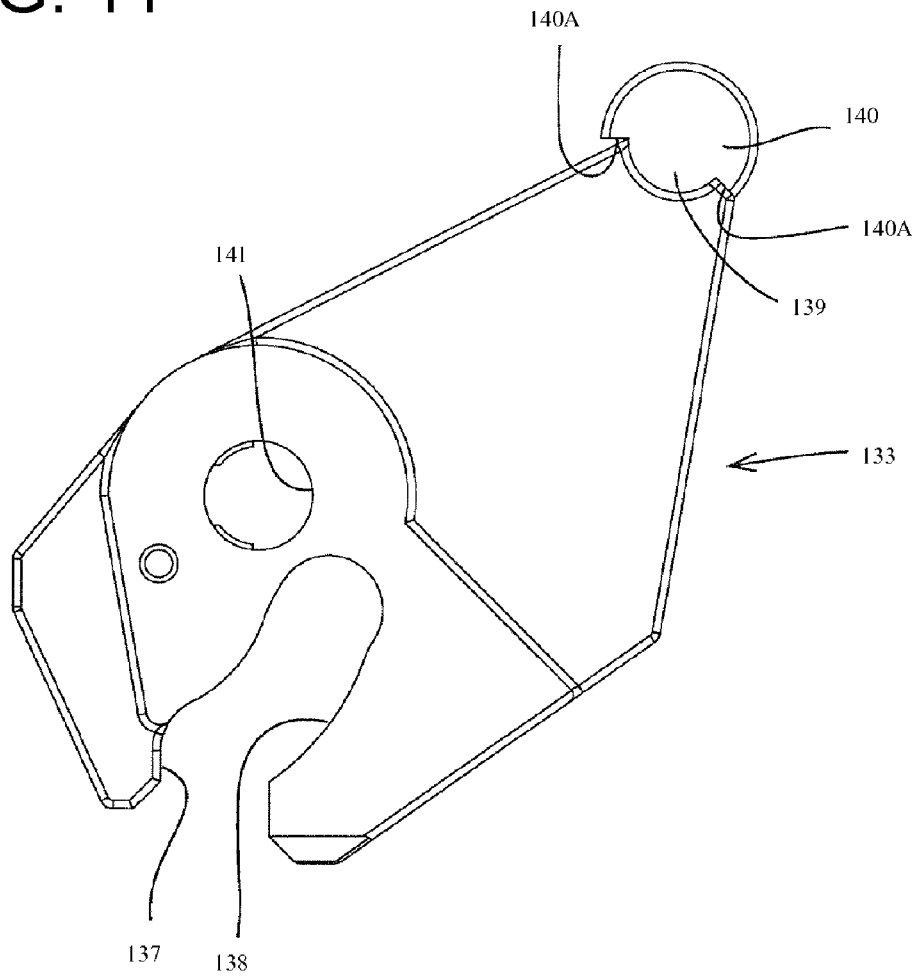
FIG. 11 is a plan view of a lever.

Each lever 133 is a plate made e.g. of synthetic resin and has one wide end and a tapered end, as shown in FIG. 11. An opening 137 is formed in the wide end of the lever 133, and an arcuate cam groove 138 extends integrally in a connecting direction from the opening 137. A coupling pin 139 projects at the tapered end and a flange 140 is formed near the leading end of the coupling pin 139. Bearing holes 141 are formed adjacent to end edges of the back ends of the cam grooves 138 and can be engaged with supporting shafts (not shown) of the wire-side housing 131. The bearing holes 141 are arranged point-symmetrically with respect to the center of the connection surface because the levers 133 are mounted on the wire-side housing 131.

Each lever 133 is mounted on the wire-side housing 131 for rotation between a connection initial state where the corresponding cam pin 114 is engaged with the opening 137 and can enter the cam groove 138, as shown in FIG. 8 or 10, and a connection completed state where the cam pin 114 reaches an end of the cam groove 138 to complete connection. The cam pins 114 are in the openings 137 when the connectors 110, 130 are in the connection initial state and align with the cam grooves 138. The cam pins 114 are guided to back end portions of the cam grooves 138 by displacing the levers 133. Thus, the two connectors 110, 130 are connected by a cam action of pulling the wire-side housing 131 into the device-side housing 111.

The holder 134 is a substantially rectangular tube made e.g. of synthetic resin, as shown in FIGS. 8 and 11, and can accommodate the levers 133 and the wire-side housing 131 inside. Resiliently deformable engaging pieces 142 are provided on the shorter outer side surfaces of the holder 134, and coupling grooves 143 are formed in the longer wall surfaces of the holder 134. The engaging pieces 142 are at positions corresponding to the inclined engaging portions 113 of the device-side housing 111, and unillustrated holding claws are formed at inner sides of the leading ends thereof. The engaging pieces 142 move onto the inclined engaging portions 113 and resiliently deform outwardly immediately before the device-side connector 110 and the wire-side connector 130 reach the connection completed state. The engaging pieces 142 resiliently restore when the connectors 110, 130 reach the connection completed state and the holding claws (not shown) engage the steps 113B of the inclined engaging portions 113 to maintain the connection completed state. Further, unlocking portions 142A are formed on the outer surfaces of rear end portions of the engaging pieces 142 and can be pressed inwardly to deform the resilient engaging pieces 142 for disengaging the steps 113B of the inclined engaging portions 13 and the holding claws (not shown) of the engaging pieces 142.

Insertable portions 144 project slightly in at opposite sides of the engaging pieces 142 and at positions facing the respective guide grooves 136 of the wire-side housing 131. The insertable portions 144 extend substantially straight from the front opening edge to the rear opening edge of the holder 134. Pressing portions 145 project in at rear end portions of the insertable portions 144 for engaging the guide grooves 136 of the wire-side housing 131. The pressing portions 145 press the guide grooves 136 at four positions when the connection of the connectors 110, 130 is completed for evenly fitting the wire-side housing 131 in the device-side housing 111 and retaining the wire-side housing 131 in the holder 134. The wire-side housing 131 is accommodated in the receptacle 112 of the device-side housing 111 when the connectors 110, 130 are connected. Outer surfaces of the receptacle 112 and the insertable portions 144 of the holder 134 slide on each other to guide the device-side housing 111 into the holder 134. Additionally, the levers 133 supported on the wire-side housing 131 are accommodated in spaces defined by the longer walls of the holder 134 and the insertable portions 144.

The coupling grooves 143 are formed in the opposite longer wall surfaces of the holder 134. Each coupling groove 143 extends straight in the connecting direction from a position displaced from the longitudinal center toward one lateral edge at the rear opening edge and then is obliquely bent at an acute angle toward the other lateral edge.

The coupling pins 139 of the levers 133 are mounted slidably in the coupling grooves 143, and the connection initial state is reached when the coupling pins 139 slightly pass the bent positions of the coupling grooves 143. The flanges 140 of the coupling pins 139 engage flange receiving portions 143A formed at peripheral edges of the coupling grooves 143 to retain the coupling pins 139 in the coupling grooves 143.

Figure 12:
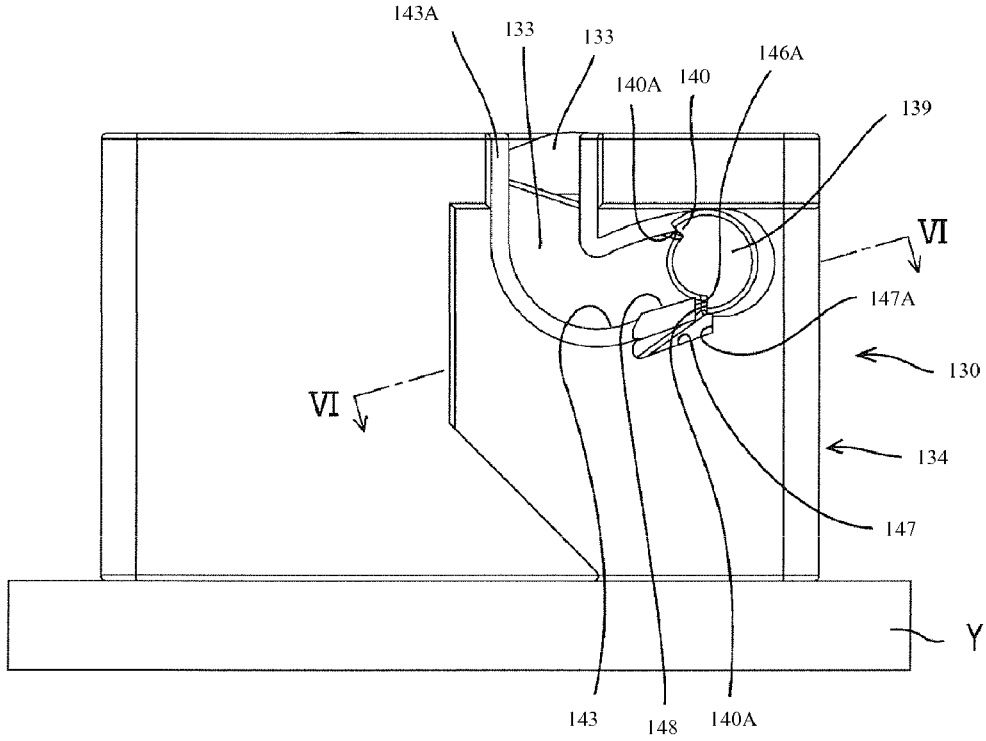
FIG. 12 is a side view showing the connection completed state of the device-side and wire-side connectors according to the second embodiment.

As shown in FIGS. 11 and 12, a part of the flange 140 of each coupling pin 139 facing the cam groove 138 is cut off to define an engaging surface 140A that is aligned at an angle to the coupling groove 143 when the connectors 110, 130 reach the connection completed state and when the coupling pin 139 reaches the back of the coupling groove 143. A resilient lock piece 146 is provided at the flange receiving portion 143A of each coupling groove 143 and has a locking surface 146A that engages the engaging surface 140A to fix the coupling pin 139 at the back end of the coupling groove 143. The resilient lock piece 146 has a substantially rectangular parallelepipedic shape, and the locking surface 146A is provided at the leading end thereof. Further, the thickness of the resilient lock piece 146 in a depth direction of the coupling groove 143 is thicker (e.g. approximately twice or more) than the thickness of the peripheral edge of the coupling groove 143.

Figure 13:
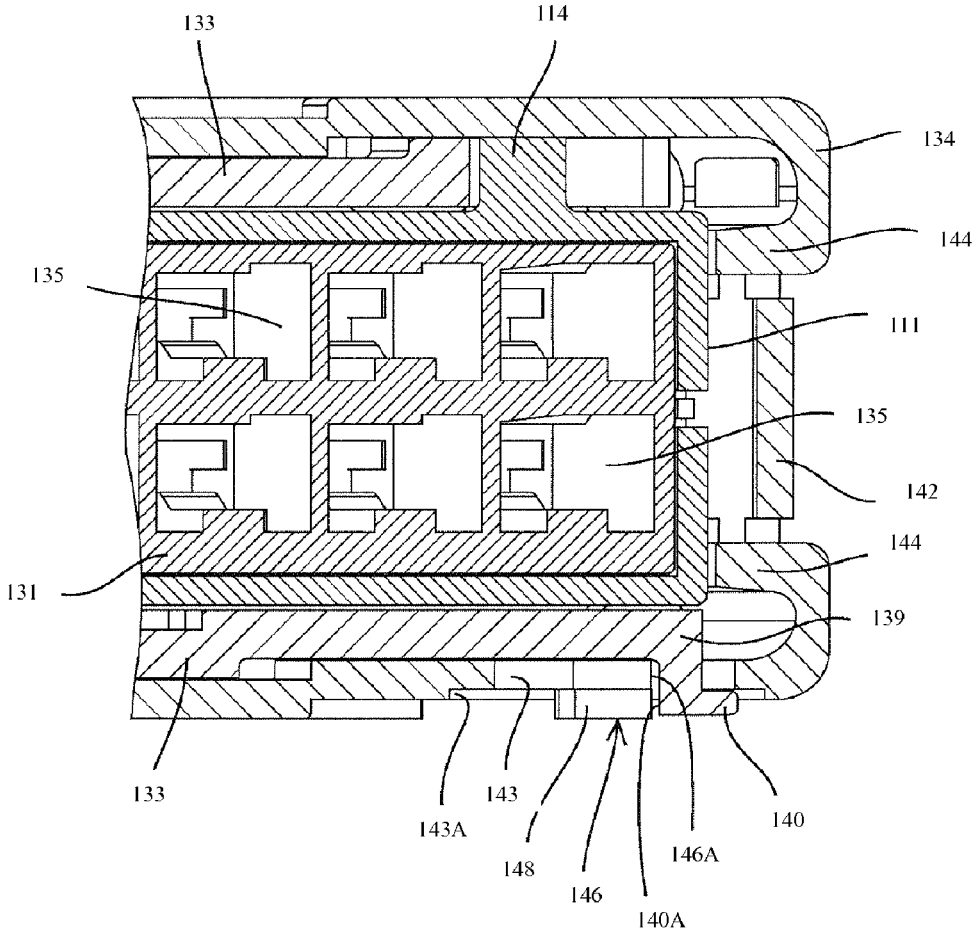
FIG. 13 is a section along VI-VI of FIG. 12.

Each resilient lock piece 146 is resiliently deformable in the connecting direction, and the coupling groove 143 where the resilient lock piece 146 is located is recessed in the connecting direction at a position where the resilient lock piece 146 is deformed to form an escaping recess 147 for allowing the resilient lock piece 146 to escape. An opening 147A of the escaping recess 147 is wider than the length of the resilient lock piece 146 so as not to hinder a resilient deformation of the resilient lock piece 146. The resilient lock piece 146 projects slightly from the wall surface of the holder 134 as shown in FIG. 13, since the resilient locking piece 146 is thicker than the wall of the holder 134. A pressable portion 148 is formed in an area where the resilient lock piece 146 projects and is pressed in the connecting direction to deform the resilient lock piece 146 in the connecting direction.

The wire-side housing 131 is accommodated in the receptacle 112 of the device-side connector 110, as shown in FIGS. 8 and 10, and the openings 137 of the levers 133 and the corresponding cam pins 114 of the device-side housing 111 engage to set the connection initial state. The holder 134 then is pushed in the connecting direction so that the coupling pins 139 of the levers 133 move toward the back ends of the coupling grooves 143 to rotate the levers 133 in connecting directions. A cam action of the cam pins 114 of the device-side housing 111 and the cam grooves 138 of the levers 133 pulls the connectors 110, 130 together in the connecting direction. The flanges 140 of the coupling pins 139 deform the resilient lock pieces 146 in the connecting direction immediately before the connectors 110, 130 reach the connection completed state. The flanges 140 move beyond the resilient lock pieces 146 and reach the back ends of the coupling grooves 143 when the connection completed state is reached. Thus, the resilient lock pieces 146 resiliently restore and the engaging surfaces 140A of the flanges 140 engage the locking surfaces 146A of the resilient lock pieces 146. The engaging pieces 142 on the shorter sides of the holder 134 engage the inclined engaging portions 113. In this way, the connectors 110, 130 are held in the connection completed state to ensure an electrically conductive state of the lever-type connector. Further, using the existing coupling pins 139 as described above, avoids a need for a separate holding member on the outer side of the holder 134, thereby preventing enlargement of the lever-type connector.

Further, the unlocking portions 142A on the shorter sides of the holder 134 are pressed at the time of separating the two connectors 110, 130 to disengage the inclined engaging portions 113 and the engaging pieces 142. Additionally, the pressable portions 148 of the resilient lock pieces 146 are pressed in the connecting direction to deform the resilient lock pieces 146 in the connecting direction for disengaging the engaging surfaces 140A of the flanges 140 of the coupling pins 139 and the locking surfaces 146A of the resilient lock pieces 146. The holder 134 then is slid in a separating direction to separate the two connectors 110, 130 easily.

Figure 14:
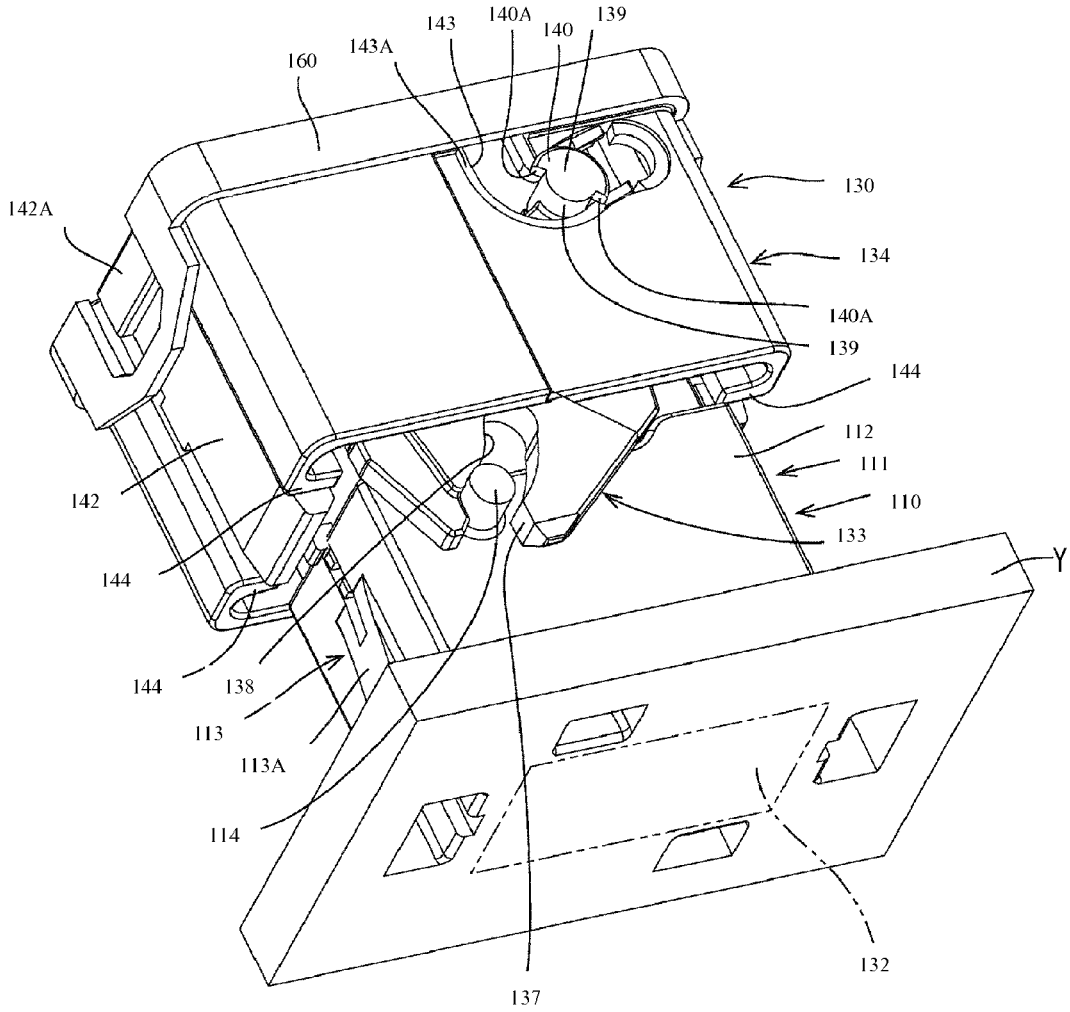
FIG. 14 is a perspective view showing a state before a device-side and a wire-side connectors according to a third embodiment of the present invention are connected.
Figure 15:
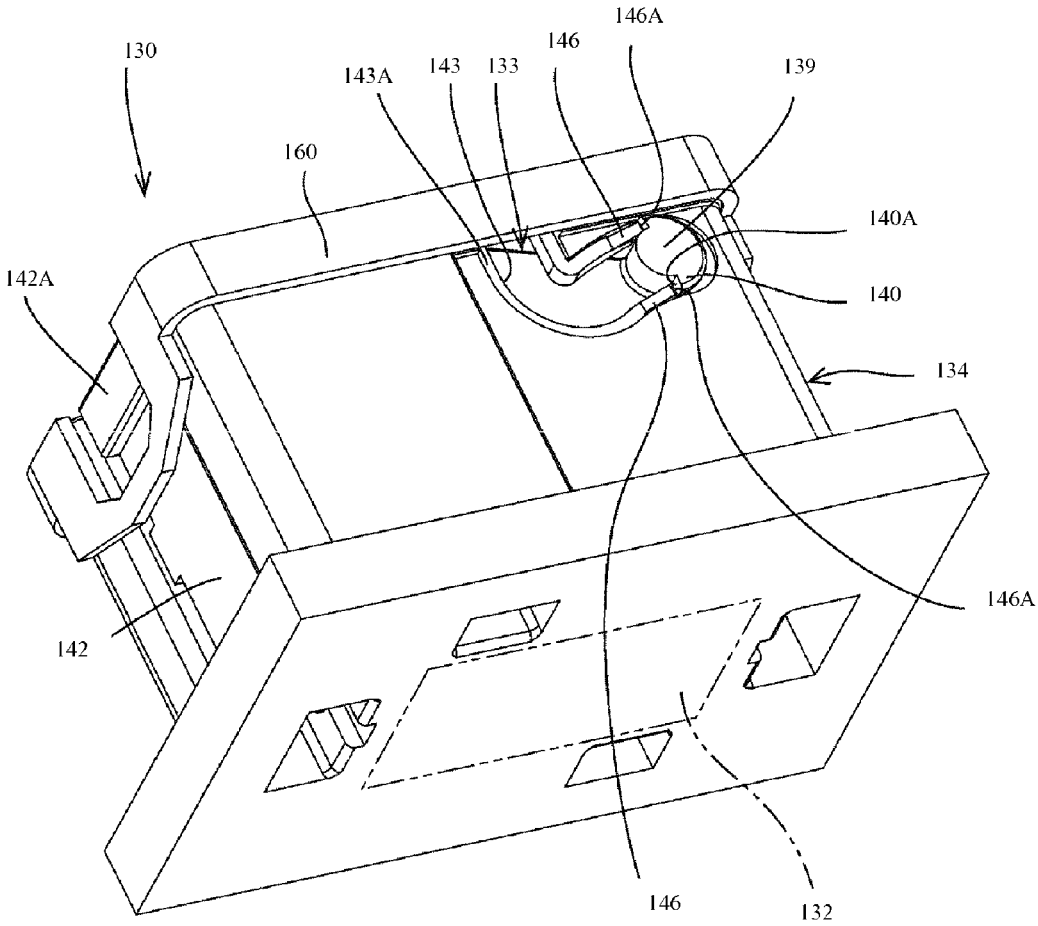
FIG. 15 is a perspective view showing a connection completed state of the device-side and wire-side connectors according to the third embodiment.
Figure 16:
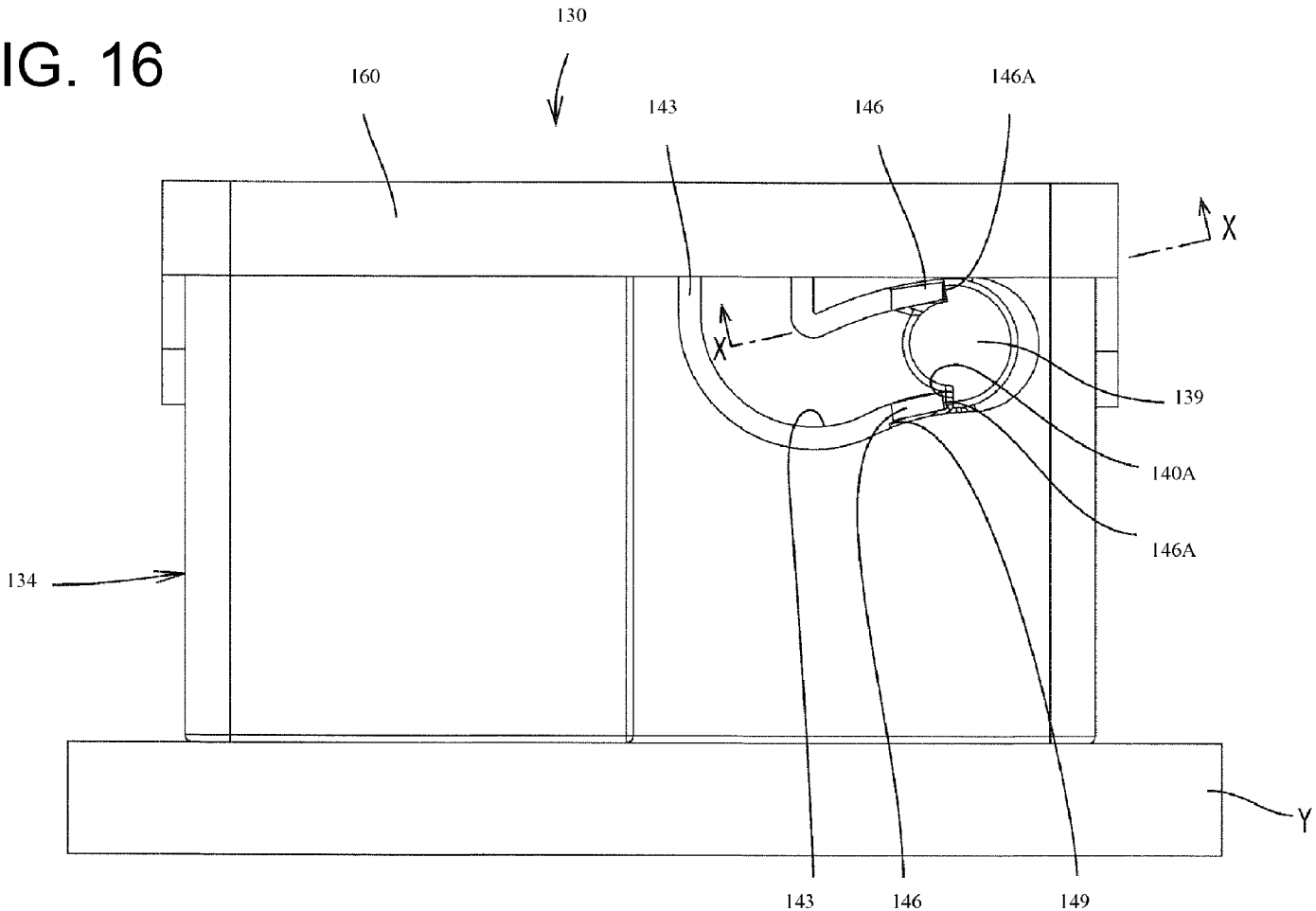
FIG. 16 is a side view showing the connection completed state of the device-side and wire-side connectors according to the third embodiment.

A lever-type connector according to a third embodiment of the invention is described with reference to FIGS. 14 to 19. The lever-type connector of this embodiment has a device-side connector 110 to be mounted on a mounting portion Y of a device and a wire-side connector 130 with terminal fittings (not shown) connected to wires, similar to the second embodiment. However, about halves of flanges 140 of coupling pins 139 are cut off so that the flanges 140 have a substantially half moon shape and two resilient lock pieces 146 are provided at a flange receiving portion 143A of a coupling groove 143 formed in the opposite side surfaces of a holder 134 at positions facing each other with the cam groove 143 therebetween. A frame 160 for preventing the coupling pins 139 from coming out of the coupling grooves 143 is provided at the rear opening edge of the holder 134. In FIGS. 14 and 15. A housing main body 132 of a device-side housing of the device-side connector is not shown to simplify the drawings.

The half moon shaped flanges 140 are at back ends of the coupling grooves 143 when the coupling pins 139 reach the back ends of the coupling grooves 143. Engaging surfaces 140A are formed at the cut-off positions of the flanges 140 at an angle to the flange receiving portions 143A of the coupling grooves 143, and locking surfaces 146A are formed at leading ends of the resilient lock pieces 146 for engaging the engaging surface 140A.

Figure 17:
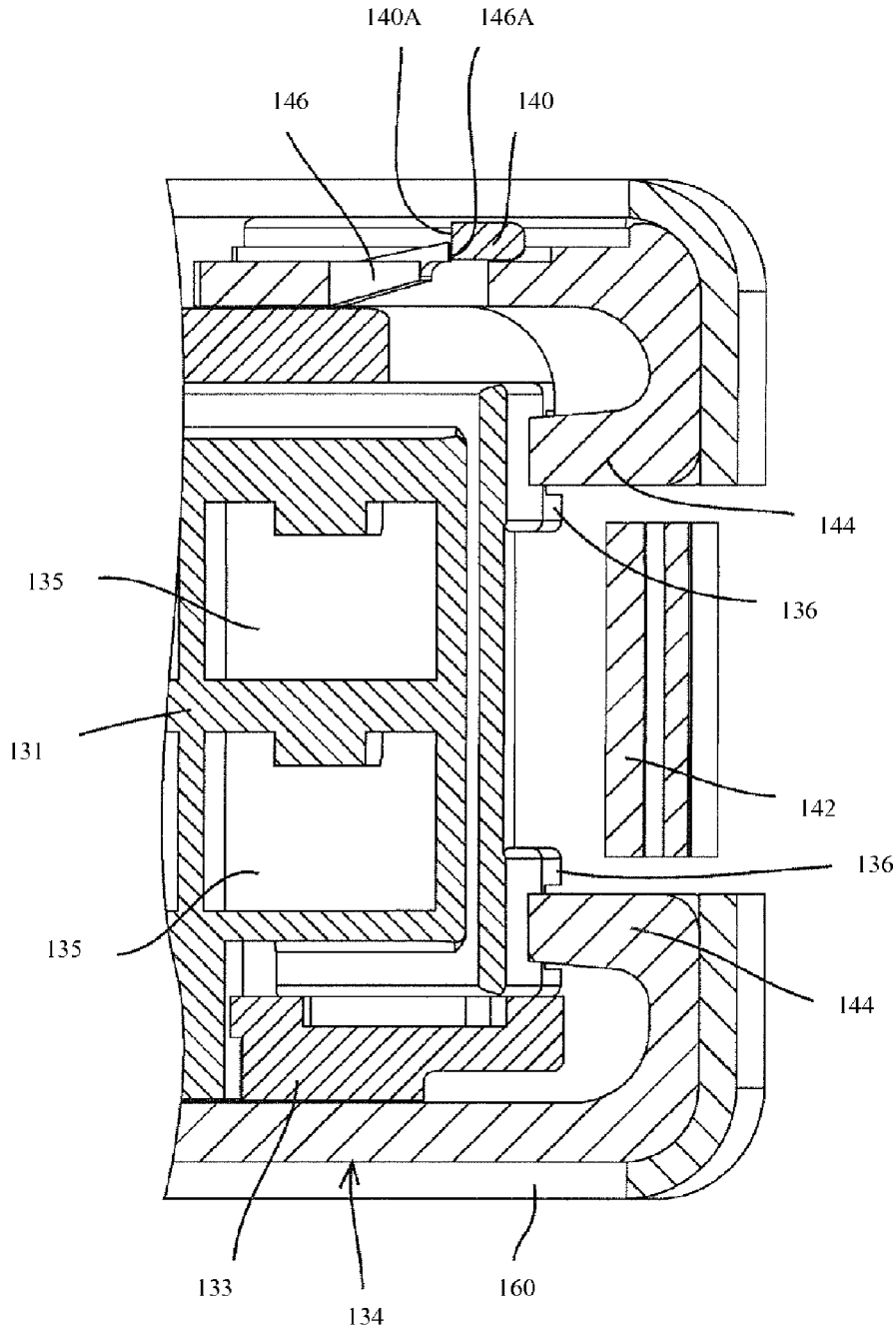
FIG. 17 is a plan view partly in section showing the connection completed state of the device-side and wire-side connectors according to the third embodiment.
Figure 18:
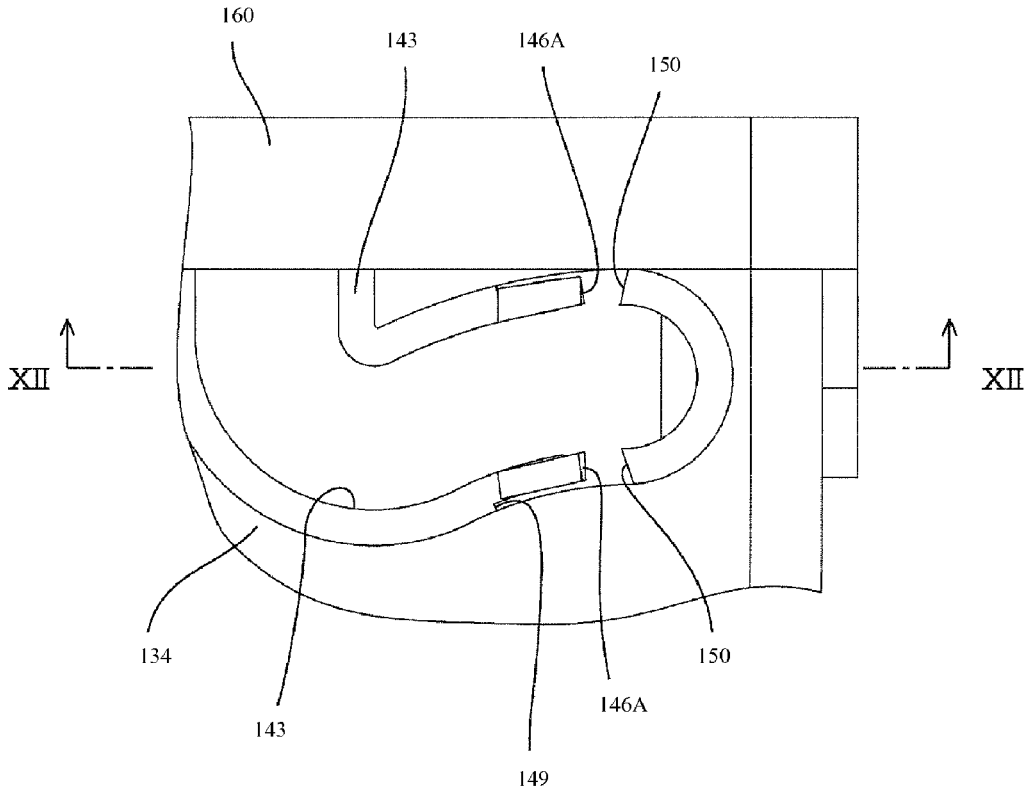
FIG. 18 is a partial enlarged view of a coupling groove part of a holder.
Figure 19:
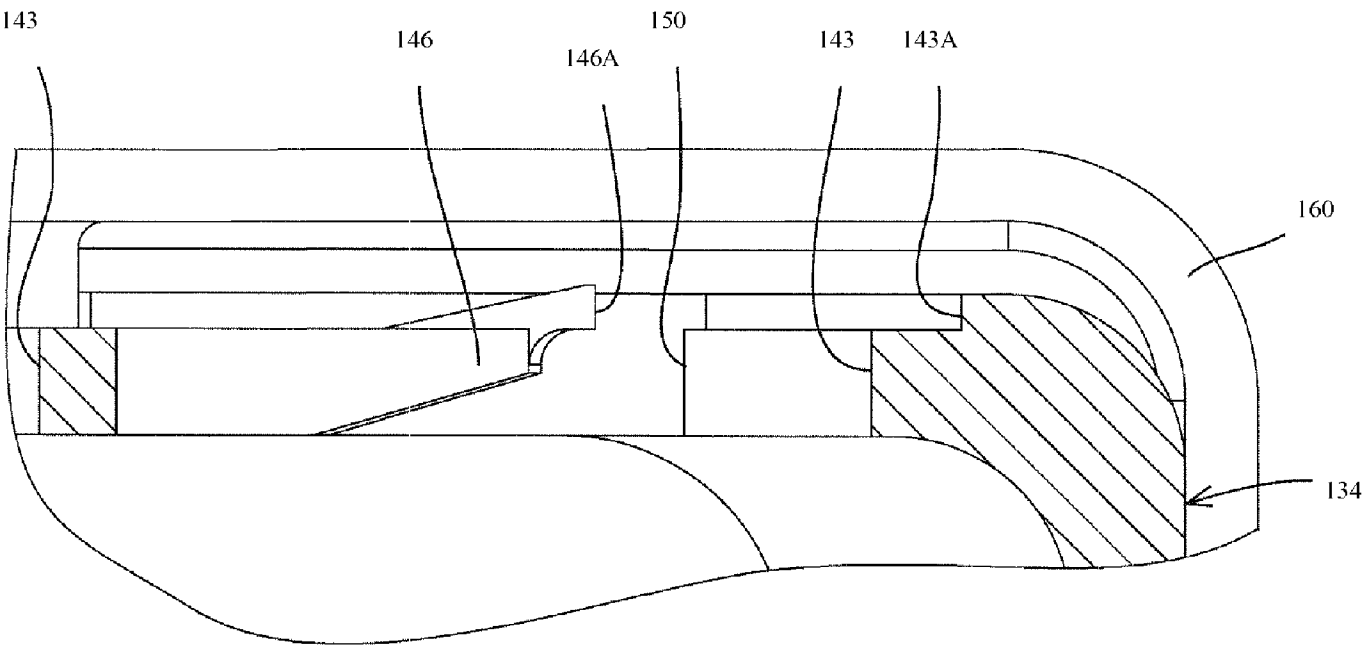
FIG. 19 is an enlarged section along XII-XII of FIG. 18.
Figure 20:
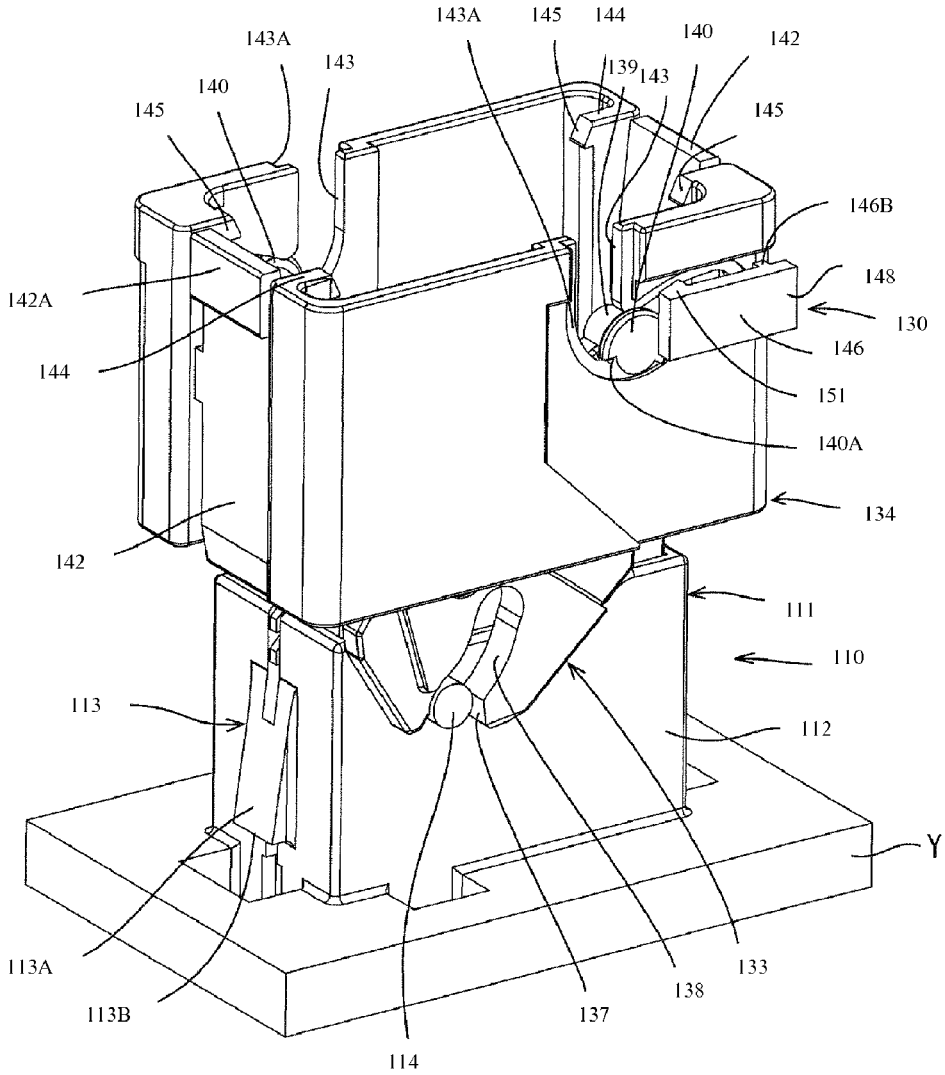
FIG. 20 is a perspective view showing a state before a device-side and a wire-side connectors according to a fourth embodiment of the present invention are connected.
Figure 21:
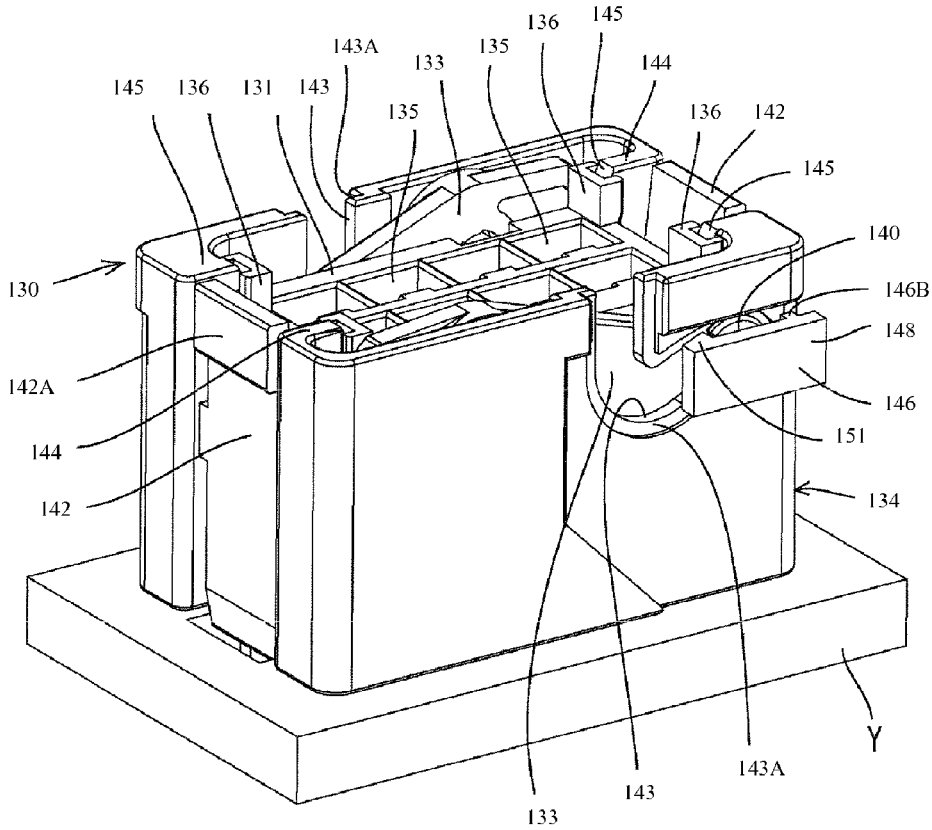
FIG. 21 is a side view showing a connection completed state of the device-side and wire-side connectors according to the fourth embodiment.
Figure 22:
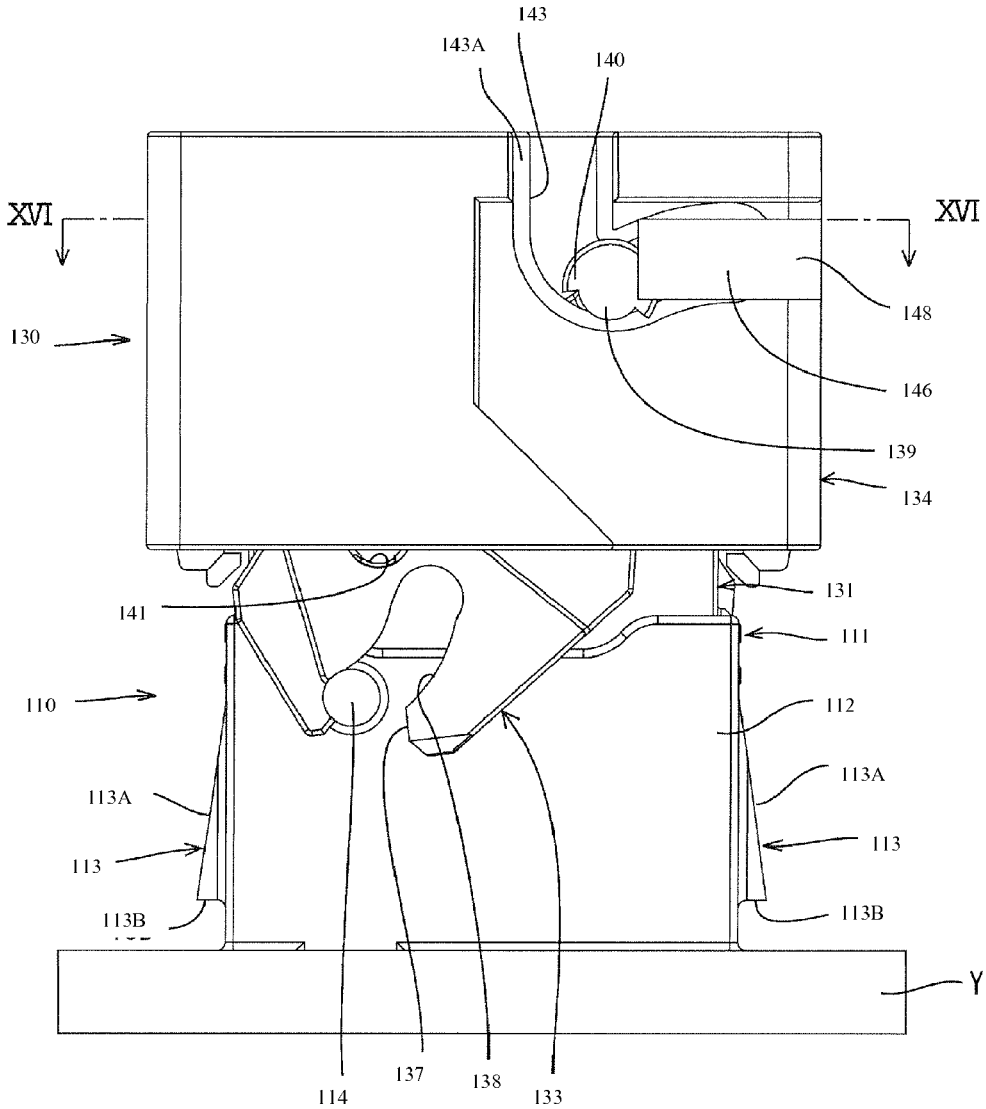
FIG. 22 is a side view showing the state before the device-side and wire-side connectors according to the fourth embodiment are connected.
Figure 23:
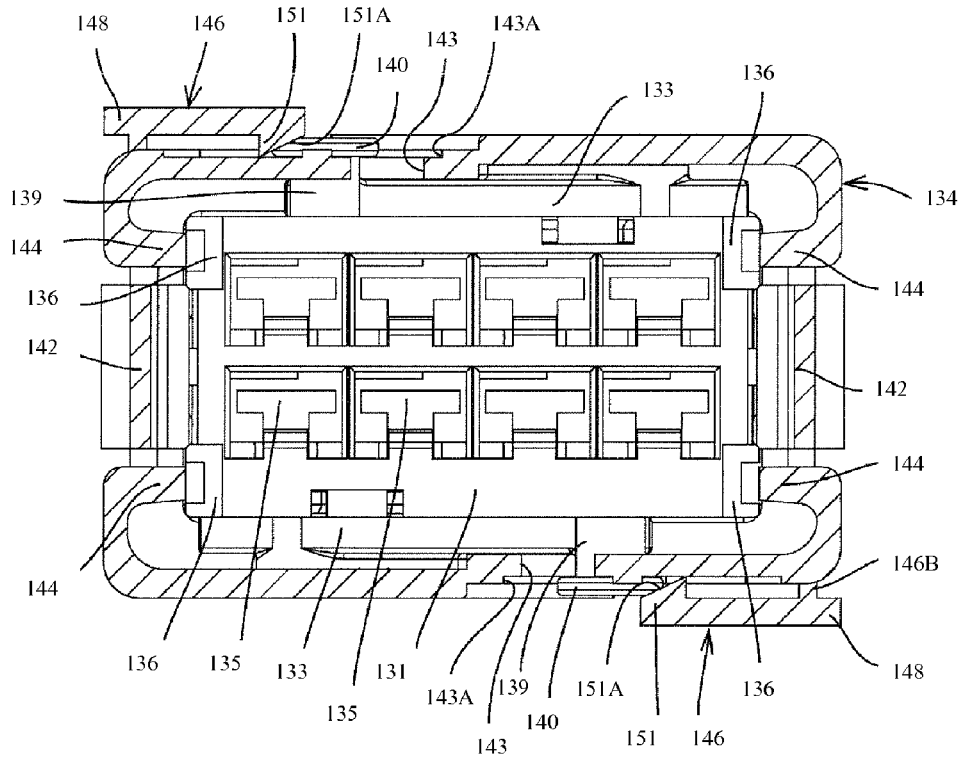
FIG. 23 is a section along XVI-XVI of FIG. 22.
Figure 24:
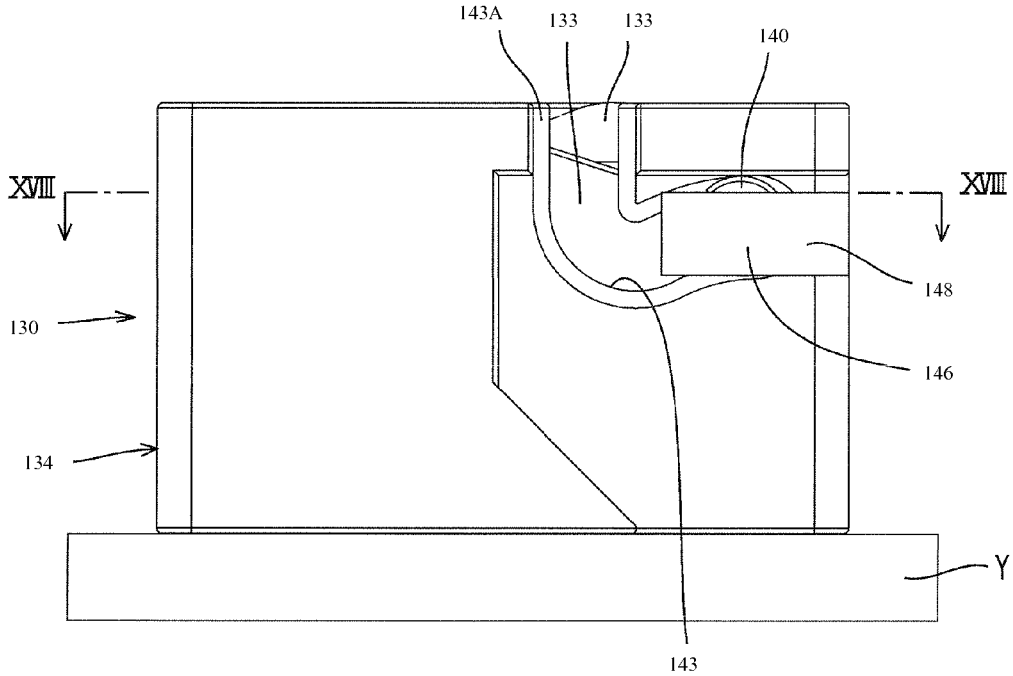
FIG. 24 is a side view showing the connection completed state of the device-side and wire-side connectors according to the fourth embodiment.
Figure 25:
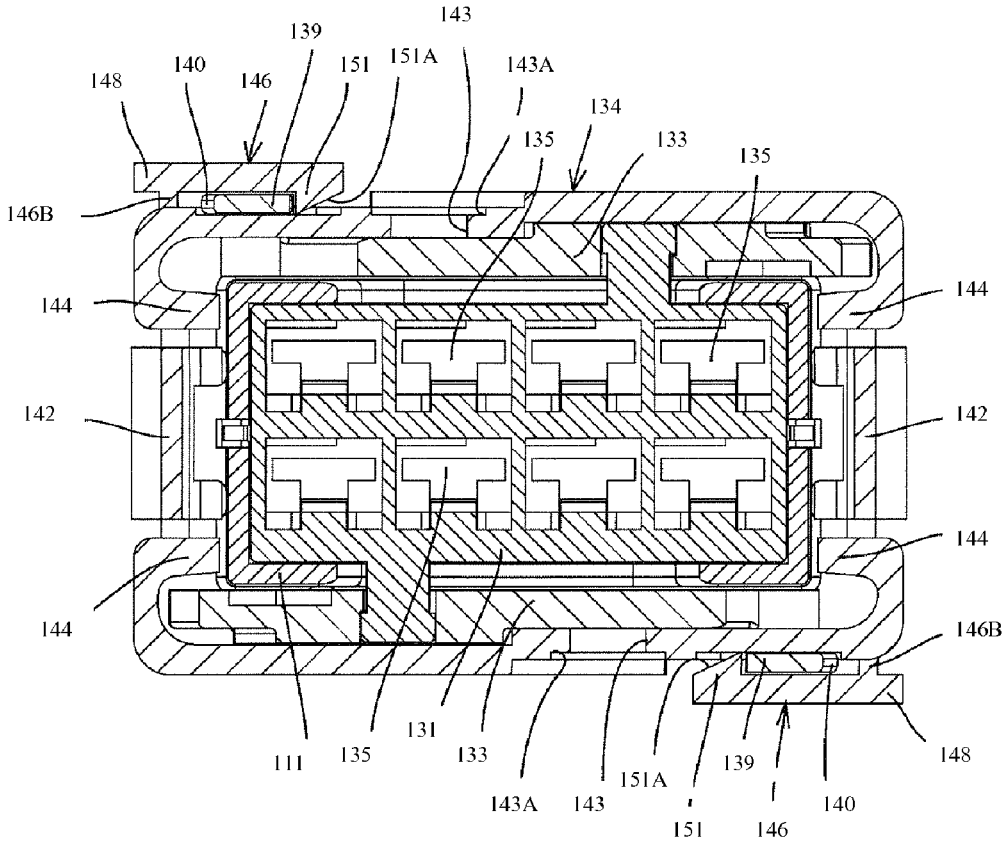
FIG. 25 is a section along XVIII-XVIII of FIG. 24.

As shown in FIGS. 17 to 19, each resilient lock piece 146 has a substantially rectangular parallelepipedic shape, is inclined slightly out from the outer surface of the holder 134 toward the back end of the coupling groove 143 and is resiliently deformable in a depth direction of the coupling groove 143. The inner surface of a leading end portion of the resilient lock piece 146 is recessed arcuately from an inner edge of the locking surface 146A located at the leading end toward the inner surface of a base end, and a slit 149 is formed between the resilient lock piece 146 and the outer peripheral edge of the flange receiving portion 143A. An escaping slit 150 is formed between the leading end of each resilient lock piece 146 and the back end of the coupling groove 143 for allowing the deformed resilient lock piece 146 to escape together with the slit 149. Other constructions are substantially similar to the second embodiment.

Similar to the second embodiment, in the third embodiment, the flange 140 of each coupling pin 139 resiliently deforms resilient lock pieces 146 in the depth direction of the corresponding coupling groove 143 immediately before the two connectors 110, 130 reach a connection completed state. When the connection completed state is reached, the flanges 140 move beyond the resilient lock pieces 146 to reach the back ends of the coupling grooves 143. Thus, the resilient lock pieces 146 restore and the engaging surfaces 140A of the flanges 140 engage the locking surfaces 146A of the resilient lock pieces 146. In this way, the two connectors 110, 130 are held in the connection completed state and an electrically conductive state of the lever-type connector is ensured without enlarging the lever-type connector.

A lever-type connector according to a fourth embodiment of the invention is illustrated in FIGS. 20 to 25. The lever-type connector of this embodiment has a device-side connector 110 to be fixed by being mounted on a mounting portion Y of a device and a wire-side connector 130 in which terminal fittings (not shown) connected to wires are mounted, similar to the second embodiment. However, resilient lock pieces 146 are provided at substantially opposite side surfaces of back ends of the coupling grooves 143. Each resilient lock piece 146 is in the form of a rectangular plate, fixed to a lateral edge of a holder 134 by a support 146B provided at a position slightly displaced toward a center from one shorter side edge, and is mounted substantially in parallel to a wall surface of the holder 134. A lock claw 151 is formed at a leading end of each resilient lock piece 146 opposite to the support 146B. The lock claw 151 has an inclined surface 151A inclined from the leading end of the resilient lock piece 146 toward the support 146B and is formed over substantially the entire width in a shorter side direction. The lock claw 151 is formed to lock a leading end portion of a coupling pin 139 when the coupling pin 139 reaches a back end of a coupling groove 143. Each resilient lock piece 146 further is formed with at least one pressable portion 148 on the outer surface of a lateral edge at the side of the support 146B. The pressable portion 148 can be pressed for resiliently deforming the resilient lock piece 146 in a direction to bring the lock claw 151 away from the holder 134. Other constructions are substantially same or similar to the second embodiment.

In the fourth embodiment, the coupling pins 139 contact the respective inclined surfaces 151A of the lock claws 151 of the resilient lock piece 146 immediately before the connectors 110, 130 reach a connection completed state. Thus, the lock claws 151 deform the resilient lock pieces 146 in directions away from the holder 134. The coupling pins 139 and the inclined surfaces 151A of the lock claws 151 are brought out of contact when the connectors 110, 130 reach the connection completed state, and the lock pieces 146 restore resiliently. Hence, the leading ends of the coupling pins 139 are locked by the lock claws 151 of the resilient lock pieces 146 so that the connectors 110, 130 are held in the connection completed state to ensure an electrically conductive state of the connector.

The pressable portions 148 of the resilient lock pieces 146 can be pressed toward the holder 134 at the time of separating the connectors 110, 130 so that the lock claws 151 deform the resilient lock pieces 146 away from the holder 134. The holder 134 then is slid in a separating direction. Other functions are similar to the second embodiment.

The invention is not limited to the above described and illustrated embodiment. For example, the following embodiments also are included in the scope of the invention.

Although the inclined engaging portions and the resilient engaging pieces are formed in the above embodiment, the invention is not limited to such a mode and the inclined engaging portions and the resilient engaging pieces may not be formed.

The engaging projections of the levers and the resilient pieces of the holder are formed for the shorter side surfaces of the holder in the above embodiment. The invention is not limited to such a mode and the engaging projection and the resilient piece may be formed for either one of the both shorter side surfaces of the holder.

Although the wire-side housing and the levers are completely accommodated in the holder corresponding to the operating member in the above embodiment, the present invention is not limited to such a mode and the holder may include, for example, an opening extending in forward and backward directions to expose the levers and the wire-side housing.

Although the resilient lock pieces are formed on both longer side surfaces of the holder in the above embodiment, the invention is not limited to such a mode and the resilient lock piece may be formed on either one of the longer side surfaces of the holder.

Although the resilient lock pieces are formed with the pressable portions in the first and third embodiments, the present invention is not limited to such a mode and the resilient lock pieces may not be formed with the pressable portions.

What is claimed is:

1. A lever-type connector, comprising:

a first housing (11; 111) and a second housing (41; 131) connectable with each other along a connecting direction;

at least one cam pin (15, 114) projecting from the first housing (11; 111);

at least one lever (60; 133) displaceably supported on the second housing (41; 131) and including at least one cam groove (62; 138) engageable with the cam pin (15; 114);

an operating member (70; 134) held on the second housing (41; 131) displaceable substantially in the connecting direction and in an opposite direction thereof;

at least one coupling pin (63; 139) and at least one coupling groove (74; 143) formed on one and the other of the lever (60; 133) and the operating member (70; 134) and engageable with each other, the coupling pin (63; 139) being guided to an end portion of the coupling groove (74; 143) by moving the operating member (70; 134) substantially in the connecting direction and thereby displacing the lever (60; 133) to move the first and second housings (11, 41; 111, 131) toward each other and into connection with each other; and a connection locking mechanism (66, 75; 142; 143, 146) for holding the housings (11, 41; 111, 131) in a connection completed state (CCS).

2. The lever-type connector of claim 1, wherein the connection locking mechanism comprises:

at least one resilient piece (75) on a surface of the operating member (70) substantially facing the lever (60) and having an engaging surface (75B), and an engaging claw (66) engageable with the engaging surface (75B) to fix the lever (60) when the housings (11, 41) reach the connection completed state (CCS).

3. The lever-type connector of claim 2, wherein the engaging surface (75B) is formed at an angle different from 0° and 180° to a sliding direction.

4. The lever-type connector of claim 2, wherein an intermediate part of the resilient piece (75) is supported on the operating member (70), the engaging claw (66) being formed at one end of the resilient piece (75) and an unlocking portion (75C) being formed on an end of the resilient piece (75) opposite the engaging claw (66), the unlocking portion (75 C) being pressable for resiliently deforming the resilient piece (75) and disengage the engaging claw (66) and the engaging surface (75B).

5. The lever-type connector of claim 2, wherein an unlocking portion (75C) is provided at an end of the operating member (70) opposite to a connection side.

6. The lever-type connector of claim 1, wherein the connection locking mechanism comprises at least one resilient lock piece (146) at a back end of the coupling groove (143) reached by the coupling pin (139) when the housings (111, 131) reach the connection completed state and adapted to hold the coupling pin (139) in position.

7. The lever-type connector of claim 6, wherein the resilient lock piece (146) is resiliently deformable substantially in a depth direction of the coupling groove (143) at a peripheral edge portion of the coupling groove (143) and a leading end portion of the resilient locking piece (146) constantly projecting from an upper end surface of the coupling groove (143).

8. The lever-type connector of claim 7, further comprising a flange (140) at an outer peripheral edge of the leading end of the coupling pin (139) projecting from the coupling groove (143) and extending along an upper end surface of the coupling groove (143), the flange (140) pressing the resilient lock piece (146) toward a bottom of the coupling groove (143) as the coupling pin (139) approaches the back end of the coupling groove (143) and resiliently restoring to lock the flange (140) after the back end is reached.

9. The lever-type connector of claim 6, wherein:

the coupling pin (139) is provided on the lever (133);

the coupling groove (143) is formed in the operating member (134); and the resilient lock piece (146) includes a support (146B) standing up from a part of the operating member (134) near the back end of the coupling groove (143) and an engaging claw (151) displaceable substantially along a longitudinal direction of the coupling pin (139) to engage the leading end of the coupling pin (139).

10. The lever-type connector of the preceding claim 6, further comprising a pressable portion (148) projecting from the resilient lock piece (146) and being pressable in a direction for disengaging the resilient lock piece (146) from the coupling pin (139).

11. A lever-type connector, comprising:

a first housing (11; 111) and a second housing (41; 131) connectable with each other along a connecting direction;

at least one cam pin (15, 114) projecting from the first housing (11; 111);

at least one lever (60; 133) displaceably supported on the second housing (41; 131) and including at least one cam groove (62; 138) engageable with the cam pin (15; 114);

an operating member (70; 134) held on the second housing (41; 131) displaceable substantially in the connecting direction and in an opposite direction thereof;

at least one coupling pin (63; 139) on the lever (60; 133);

at least one coupling groove (74; 143) formed on the operating member (70; 134) and engageable with the coupling pin (63; 139) so that the coupling pin (63; 139) is guided to an end of the coupling groove (74; 143) by moving the operating member (70; 134) substantially in the connecting direction and thereby displacing the lever (60; 133) to move the first and second housings (11, 41; 111, 131) toward each other and into connection with each other; and a connection locking mechanism (66, 75; 142; 143, 146) having engageable parts formed on the lever (60; 133) and on the operating member (70; 134) and engageable with one another for holding the housings (11, 41; 111, 131) in a connection completed state (CCS).

12. The lever-type connector of claim 11, wherein the connection locking mechanism comprises:

at least one resilient piece (75) on a surface of the operating member (70) substantially facing the lever (60) and having an engaging surface (75B); and an engaging claw (66) engageable with the engaging surface (75B) to fix the lever (60) when the housings (11, 41) reach the connection completed state (CCS).

13. The lever-type connector of claim 12, wherein an intermediate part of the resilient piece (75) is supported on the operating member (70), the engaging claw (66) being formed at one end of the resilient piece (75) and an unlocking portion (75C) being formed on an end of the resilient piece (75) opposite the engaging claw (66), the unlocking portion (75 C) being pressable for resiliently deforming the resilient piece (75) and disengage the engaging claw (66) and the engaging surface (75B).

14. The lever-type connector of claim 13, wherein an unlocking portion (75C) is provided at an end of the operating member (70) opposite to a connection side.

* * * * *